US009315049B2

(12) United States Patent
Kano

(10) Patent No.: US 9,315,049 B2
(45) Date of Patent: Apr. 19, 2016

(54) FEED DEVICE AND PRINTER

(71) Applicant: Brother Kogyo Kabushiki Kaisha, Nagoya-shi, Aichi-ken (JP)

(72) Inventor: Yasutoshi Kano, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/489,953

(22) Filed: Sep. 18, 2014

(65) Prior Publication Data

US 2015/0183238 A1 Jul. 2, 2015

(30) Foreign Application Priority Data

Dec. 27, 2013 (JP) ..... 2013-271685
Dec. 27, 2013 (JP) ..... 2013-271691

(51) Int. Cl.
*B41J 11/70* (2006.01)
*B65H 20/38* (2006.01)
*B65H 20/02* (2006.01)

(52) U.S. Cl.
CPC ..... *B41J 11/703* (2013.01); *B65H 20/02* (2013.01); *B65H 2403/721* (2013.01); *B65H 2404/1441* (2013.01); *B65H 2701/1849* (2013.01); *B65H 2801/12* (2013.01)

(58) Field of Classification Search
CPC ..... B41J 11/703; B65H 20/38; B65H 5/062; B65H 29/125; B65H 2404/14; B65H 2404/142
USPC ..... 347/104, 218; 226/176; 271/272, 273, 271/275
See application file for complete search history.

(56) References Cited

U.S. PATENT DOCUMENTS

2004/0207708 A1* 10/2004 Ohashi et al. ..... 347/104
2008/0143035 A1* 6/2008 Ishihara et al. ..... 271/10.11
2011/0261130 A1* 10/2011 Hirai et al. ..... 347/104
2012/0008999 A1* 1/2012 Yamaguchi et al. ..... 400/196
2013/0202342 A1* 8/2013 Kosuge et al. ..... 400/621

FOREIGN PATENT DOCUMENTS

JP 2000-071523 A 3/2000
JP 3852215 B2 11/2006

* cited by examiner

*Primary Examiner* — Manish S Shah
*Assistant Examiner* — Roger W Pisha, II
(74) *Attorney, Agent, or Firm* — Banner & Witcoff, Ltd.

(57) ABSTRACT

A second roller is configured to move between a clamping position and a released position and to rotate in a forward rotation direction and a reverse rotation direction. An energizing portion is configured to move between a contact position and a separated position. A coupled portion protrudes from the second roller. A restricting portion is configured to move between a restricting position and a permitting position. A actuating portion is configured to cause the second roller to move from the released position to the clamping position, then to cause the energizing portion to move from the separated position to the contact position, and then to cause the restricting portion to move from the restricting position to the permitting position. A clutch is configured to permit the second roller to rotate in the forward rotation direction and to restrict the second roller from rotating in the reverse rotation direction.

11 Claims, 15 Drawing Sheets

400
314
324
57
440
430
431A
432A
432
432B
432C
432D
433
433A
454
456
458
450
452
471
472
472A
472B
490
490A
490B
491
419

FEED DEVICE AND PRINTER

CROSS-REFERENCE TO RELATED APPLICATION

This application claims priority to Japanese Patent Applications No. 2013-271685, filed Dec. 27, 2013, and No. 2013-271691, filed Dec. 27, 2013. The disclosure of the foregoing applications is incorporated herein by reference in its entirety.

BACKGROUND

The present disclosure relates to a feed device and a printer that are configured to convey a sheet material.

In known art, a feed device is known that feeds a cut tape. The known feed device is provided with a fixed roller, a movable roller, a pressing member, an elastic member, and a hook member, for example. The fixed roller and the movable roller, which are disposed opposite one another, clamp the tape that will be cut. The pressing member, which is energized by the elastic member, presses on the movable roller. The rotation of the movable roller is restricted by the hook member coming into contact with the movable roller. When the hook member moves away from the movable roller, the pressing member causes the movable roller to rotate. The rotating movable roller feeds the tape by operating in coordination with the fixed roller.

SUMMARY

In the known feed device, cases occur in which the rotation of the movable roller becomes unstable. In those cases, there is a possibility that the feed amount for the tape that is being fed by the movable roller will become unstable.

Various embodiments of the broad principles derived herein provide a feed device and a printer that are configure to stabilize the feed amount for a sheet material.

The embodiments herein provide a feed device that includes a first roller, a second roller, an energizing portion, a coupled portion, a restricting portion, an actuating portion, and a clutch. The second roller is configured to move between a clamping position and a released position and is configured to rotate in a forward rotation direction and a reverse rotation direction The forward rotation direction and the reverse rotation direction are opposite rotational directions. The clamping position is a position in which the second roller clamps a sheet material between the first roller and the second roller. The released position is a position in which the second roller is separated from the first roller than when the second roller is in the clamping position. The second roller is also configured to feed the sheet material that is clamped between the first roller and the second roller toward a discharge position when the second roller is in the clamping position and rotates in the forward rotation direction. The energizing portion is configured to move between a contact position and a separated position. The contact position is a position in which the energizing portion is in contact with the second roller that is in the clamping position and energizes the second roller in the forward rotation direction. The separated position is a position in which the energizing portion is separated from the second roller that is in the clamping position. The coupled portion is coupled with and protrudes from the second roller. The coupled portion is configured to rotate in the forward rotation direction together with the second roller. The restricting portion is configured to move between a restricting position and a permitting position. The restricting position is a position in which the restricting portion is in a rotation area and restricts the rotation of the second roller. The rotation area is an area that the coupled portion describes when the coupled portion rotates in the forward rotation direction. The permitting position is a position in which the restricting portion is outside the rotation area and permits the second roller to rotate. The actuating portion is configured to cause the second roller to move from the released position to the clamping position, then to cause the energizing portion to move from the separated position to the contact position, and then to cause the restricting portion to move from the restricting position to the permitting position. The clutch is configured to permit the second roller to rotate in the forward rotation direction and to restrict the second roller from rotating in the reverse rotation direction.

The embodiments herein also provide a feed device that includes a first roller, a second roller, a first protruding portion, a plurality of second protruding portions, a first restricting member, an energizing portion, a second restricting member, a first actuating portion, and a second actuating portion. The second roller is configured to move between a clamping position and a released position and is configured to rotate in a forward rotation direction and a reverse rotation direction The forward rotation direction and the reverse rotation direction are opposite rotational directions. The clamping position is a position in which the second roller clamps a sheet material between the first roller and the second roller. The released position is a position in which the second roller is separated from the first roller than when the second roller is in the clamping position. The second roller is also configured to feed the sheet material that is clamped between the first roller and the second roller toward a discharge position when the second roller is in the clamping position and rotates in the forward rotation direction. The first protruding portion is provided on the second roller and protrudes in a direction that is parallel to a rotational axis of the second roller. The plurality of second protruding portions are provided in the first protruding portion and protrude in directions that are orthogonal to the rotational axis of the second roller. The first restricting member is configured to move between a first restricting position and a first permitting position. The first restricting position is a position in which the first restricting member is in a first rotation area and restricts the rotation of the second roller in the forward rotation direction. The first rotation area is an area that the first protruding portion describes when the first protruding portion rotates in the forward rotation direction. The first permitting position is a position in which the first restricting member is outside the first rotation area and permits the second roller to rotate in the forward rotation direction. The energizing portion is configured to move between a contact position and a separated position. The contact position is a position in which the energizing portion is in contact with one of the plurality of the second protruding portions and energizes the second protruding portion with which the energizing portion is in contact in the forward rotation direction. The separated position is a position in which the energizing portion is separated from the rotational axis of the second roller than when the energizing portion is in the contact position. The energizing portion is also configured to cause the second roller to rotate in the forward rotation direction when the energizing portion moves to the contact position. The second restricting member is configured to move between a second restricting position and a second permitting position. The second restricting position is a position in which the second restricting member is in a second rotation area and restricts the rotation of the second roller in the forward rotation direction. The second rotation area is an area that the plurality of the second protruding portions describe when the plurality of the second protruding portions rotate in the forward rotation direction. The second permitting position is a position in which the second restricting member is outside the second rotation area and permits the second roller to rotate in the forward rotation direction. The second restricting member is also configured to cause the rotation of the second roller to stop in a specific rotational position by coming into contact with a specific one of the second protruding portions when the second restricting member reaches the second restricting position. The specific one of the second protruding portions is a different one of the plurality of the second protruding portions from the second protruding portion with which the energizing portion comes into contact. The first actuating portion is configured to move the energizing portion from the separated position to the contact position, and then to move the first restricting member from the first restricting position to the first permitting position and move the second restricting member from the second permitting position to the second restricting position. The second actuating portion is configured to move the second restricting member from the second restricting position to the second permitting position and then to cause the second roller that is rotated by the first actuating portion to rotate farther in the forward rotation direction while maintaining a state in which the second roller is in the clamping position, and then to cause the second roller.

BRIEF DESCRIPTION OF THE DRAWINGS

Embodiments of the present disclosure will be described below in detail with reference to the accompanying drawings in which.

DETAILED DESCRIPTION

A first embodiment of the present disclosure will be explained with reference to the drawings. In the following explanation, for expediency, the lower right side, the upper left side, the lower left side, the upper right side, the upper side and the lower side of FIG. 1 respectively correspond to the front side, the rear side, the left side, the right side, the upper side and the lower side of a printer 1 and a tape cassette 30. In the present embodiment, various types of a sheet material housed in the tape cassette 30 (a heat-sensitive paper tape, a print tape 57 that will be explained later, a double-sided adhesive tape, a tube tape, or a film tape, for example) are collectively referred to as a tape.

Outline Structure of Printer 1

The printer 1 will be explained with reference to FIG. 1 to FIG. 3. In FIG. 2, for ease of understanding, a top surface of a cassette case 31 is omitted. The printer 1 is a general-purpose tape printer that is configured to use various tape cassettes, such as a thermal type, a receptor type, a laminate type or a tube type etc.

Figure 1:
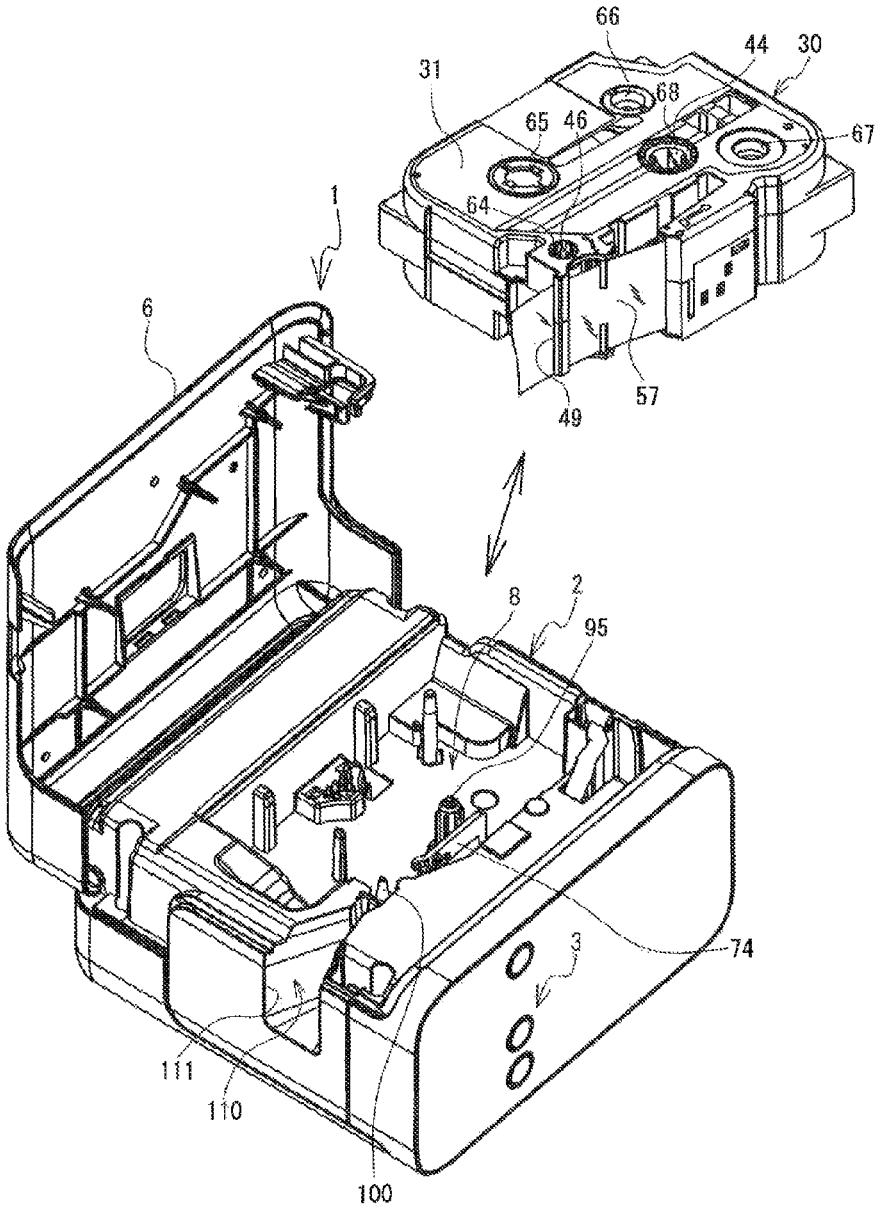
FIG. 1 is a perspective view of a printer and a tape cassette.
Figure 2:
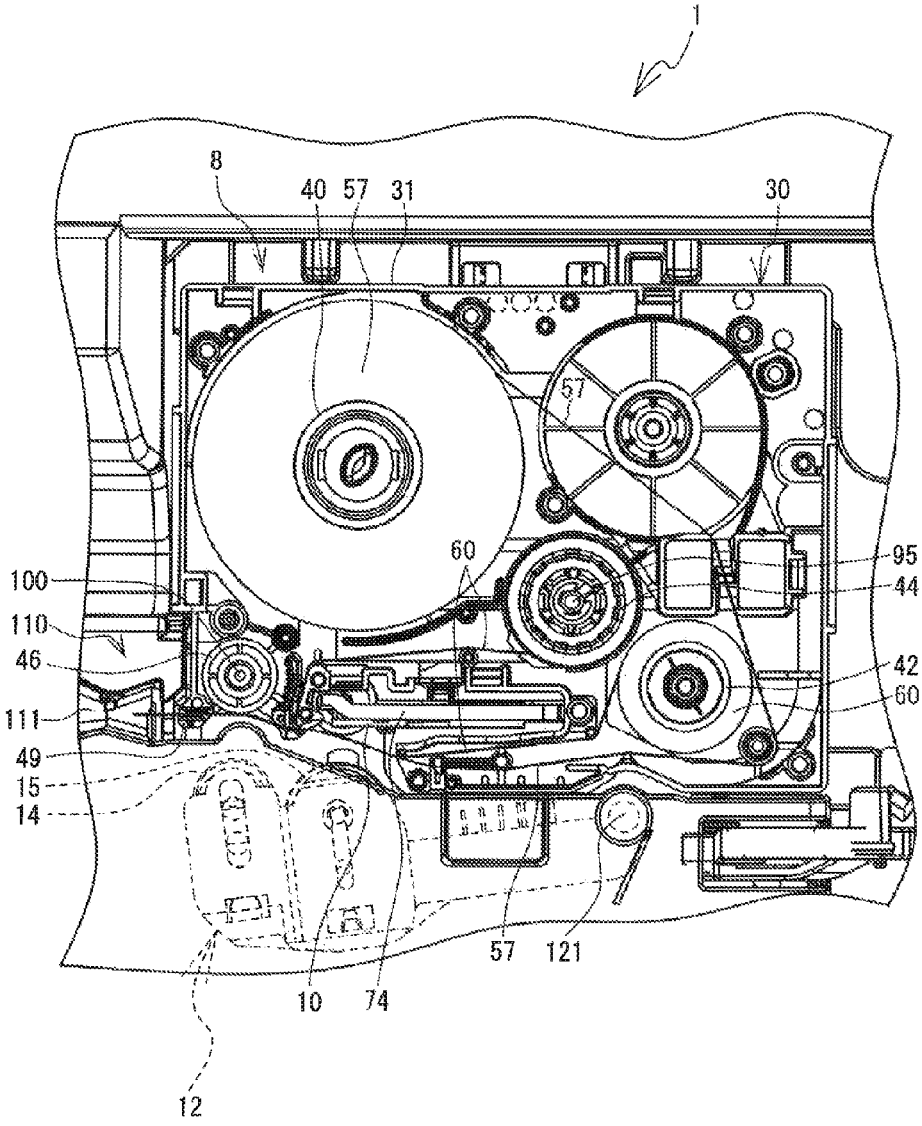
FIG. 2 is a plan view showing a state in which the tape cassette is mounted in a cassette mounting portion.

As shown in FIG. 1, the printer 1 is provided with a substantially cuboid shaped main body cover 2. Switches 3 to operate the printer 1, such as a power switch of the printer 1, are arranged on the front face of the main body cover 2. The printer 1 can be connected to a personal computer (not shown in the drawings, hereinafter referred to as a PC) via a cable (not shown in the drawings) or the like. For example, the printer 1 performs printing of characters on the tape, based on data of characters (letters, numbers, graphics etc.) transmitted from the PC.

On the top surface of the printer 1, a cassette cover 6 is provided, which is opened and closed when replacing the tape cassette 30. The cassette cover 6 is a lid portion that is substantially rectangular in a plan view. The cassette cover 6 is axially supported at both left and right end portions, at the top of the rear surface of the main body cover 2. A cassette mounting portion 8, which is an area into and from which the tape cassette 30 can be mounted and removed, is provided in the main body cover 2. The cassette cover 6 can rotate between a closed position (not shown in the drawings) in which it closes off the cassette mounting portion 8 and an open position (refer to FIG. 1) in which it opens up the cassette mounting portion 8.

A discharge port 111 is provided in the left side surface of the main body cover 2. The discharge port 111 is an opening through which the printed tape is discharged from the cassette mounting portion 8. The main body cover 2 has a tape discharge portion 110, which forms a feed path of the printed tape, between the cassette mounting portion 8 and the discharge port 111. A cutting mechanism 80 (refer to FIG. 3), which will be explained later, is provided in the tape discharge portion 110.

As shown in FIG. 1 and FIG. 2, a head holder 74 is provided in a standing manner on a front portion of the cassette mounting portion 8. The front surface of the head holder 74 is provided with a thermal head 10 that includes a heating element (not shown in the drawings). A ribbon take-up shaft 95 is provided in a standing manner to the rear of the head holder 74. The ribbon take-up shaft 95 is a shaft-shaped member that can be mounted on and removed from a ribbon take-up spool 44 of the tape cassette 30. A tape drive shaft 100 is provided in a standing manner to the left of the head holder 74. The tape drive shaft 100 is a shaft-shaped member that can be mounted on and removed from a tape drive roller 46 of the tape cassette 30.

A platen holder 12, which can pivot around a shaft support portion 121, is disposed to the front of the head holder 74. A platen roller 15 and a movable feed roller 14 are rotatably and axially supported on the left end portion of the platen holder 12. The platen roller 15 faces the thermal head 10 and can come into contact with or be separated from the thermal head 10. The movable feed roller 14 faces the tape drive roller 46 that is mounted on the tape drive shaft 100, and can come into contact with or be separated from the tape drive roller 46. A tape drive motor 711 (refer to FIG. 4), which is a stepping motor, is disposed below the cassette mounting portion 8.

Figure 3:
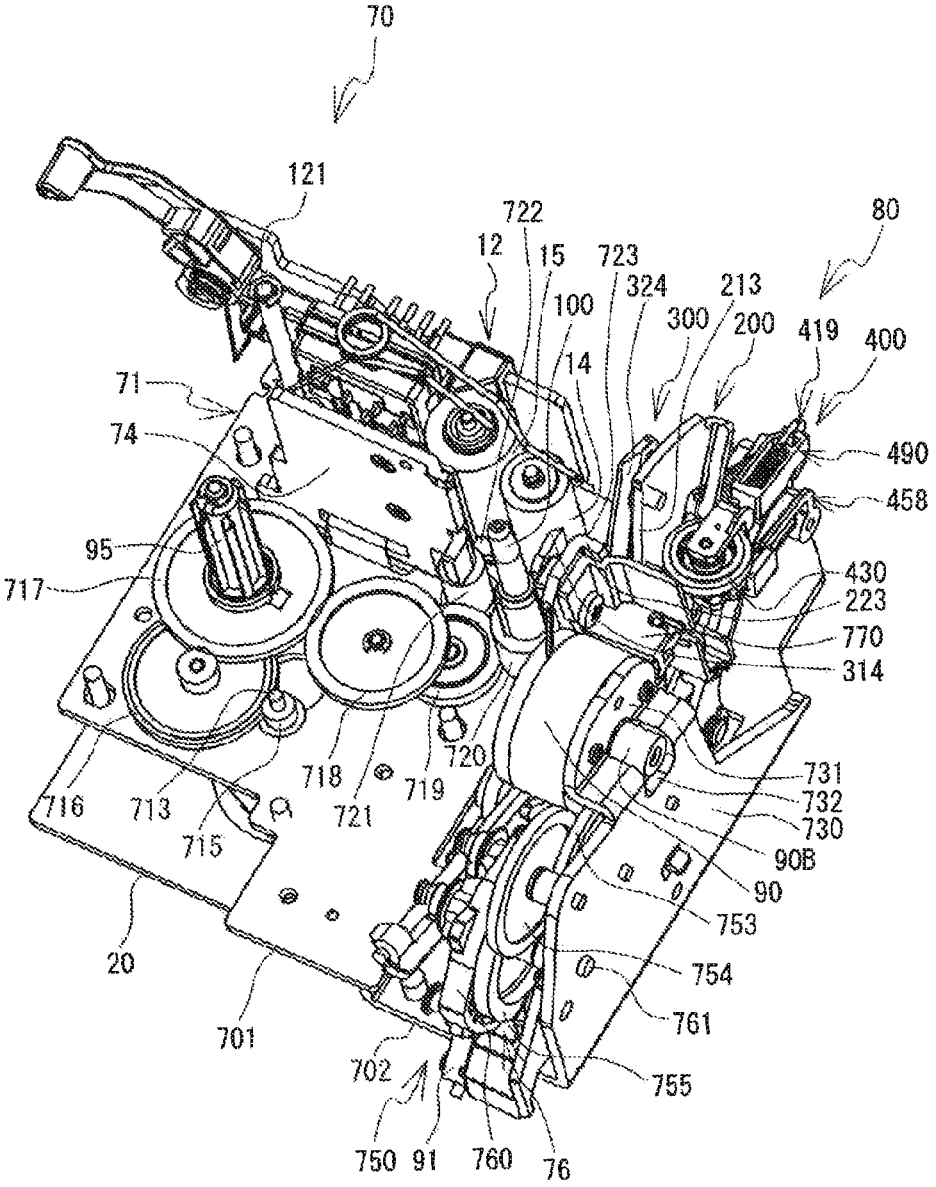
FIG. 3 is a perspective view of a unit as seen from diagonally above.

As shown in FIG. 2 and FIG. 3, when the cassette cover 6 (refer to FIG. 1) is rotated from the open position to the closed position, the platen holder 12 moves toward a printing position. The platen holder 12 that has moved to the printing position is in close proximity to the cassette mounting portion 8. At this time, a gear 722 that is provided below the platen roller 15 meshes with a gear 721 and a gear 723 that is provided below the movable feed roller 14 meshes with a gear 720.

Overview of Structure of Tape Cassette 30

The tape cassette 30 will be explained with reference to FIG. 1 and FIG. 2. The tape cassette 30 is a general-purpose cassette in which, by changing the type of the tape housed internally and the presence or absence of an ink ribbon etc., as appropriate, the above-described thermal type, receptor type, laminate type and tube type or the like can be mounted. FIG. 2 illustrates the receptor type tape cassette 30.

The tape cassette 30 is provided with a box-shaped cassette case 31. A discharge guide portion 49, which guides the tape that is discharged from the tape cassette 30, is provided in a front left portion of the cassette case 31. The cassette case 31 has support holes 65 to 68 that rotatably support a spool or the like mounted inside the cassette case 31. The support hole 65 rotatably supports a first tape spool 40 around which a first tape is wound. The support hole 67 rotatably supports a ribbon spool 42 around which an unused ink ribbon 60 is wound. The support hole 68 rotatably supports the ribbon take-up spool 44 that is used to take up the used ink ribbon 60. The support hole 66 rotatably supports a second tape spool (not shown in the drawings) around which a second tape is wound.

In the receptor type tape cassette 30 shown in FIG. 2, the support hole 65 supports the first tape spool 40 around which the print tape 57, which is the first tape, is wound. The print tape 57 of the present embodiment is a laminated tape in which a print layer and a release layer are laminated together with adhesive. The second tape is not used in the receptor type tape cassette 30 and the support hole 66 does not support the second tape spool. Although not shown in the drawings, in the laminate type tape cassette 30, the support hole 65 supports the first tape spool 40 around which a double-sided adhesive tape, which is the first tape, is wound. The support hole 66 supports the second tape spool around which a film tape, which is the second tape, is wound.

Overview of Structure of Unit 70

Figure 4:
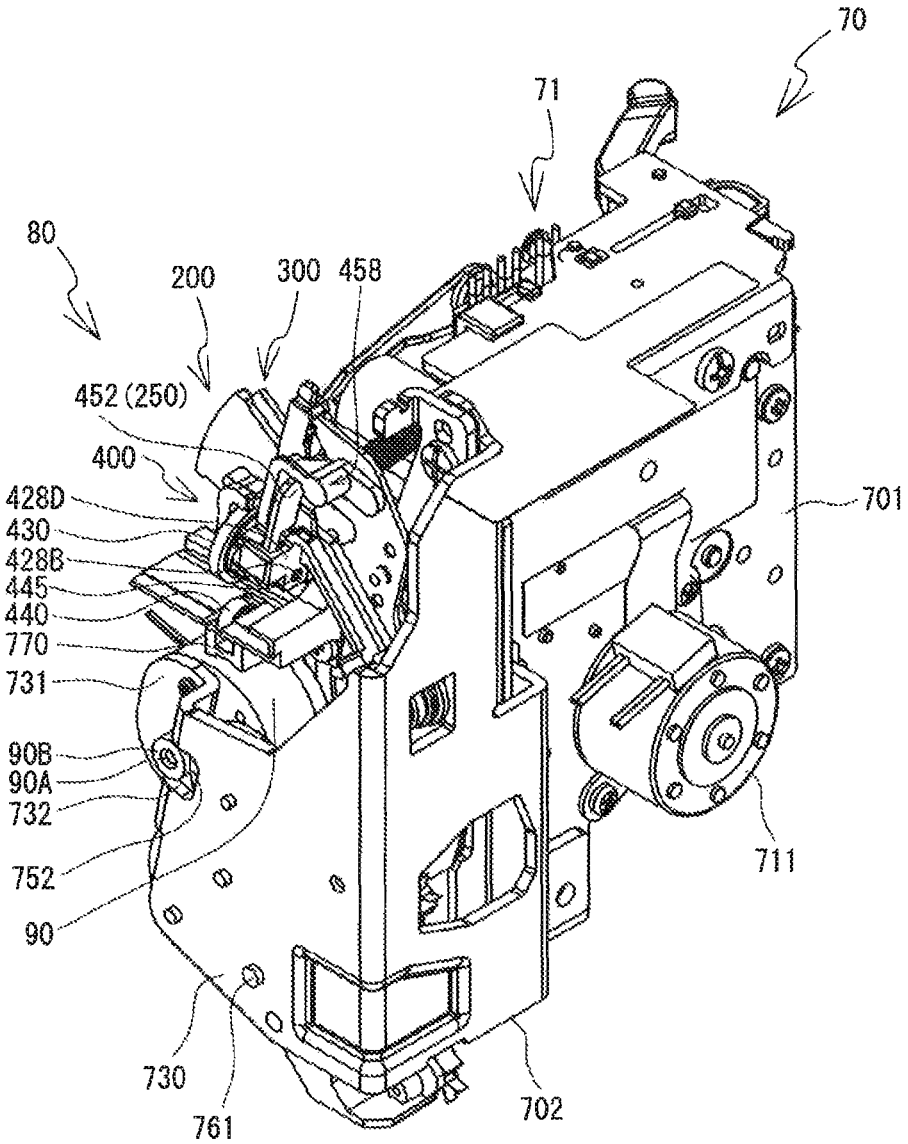
FIG. 4 is a perspective view of the unit as seen from diagonally below.

A unit 70 will be explained with reference to FIG. 3 and FIG. 4. The upper right side, the lower left side, the lower right side, the upper left side, the upper side and the lower side of FIG. 3 respectively correspond to the front side, the rear side, the left side, the right side, the upper side and the lower side of the tape printer 1 shown in FIG. 1 and FIG. 2. In FIG. 3 and FIG. 4, illustration of the exterior of the platen holder 12 shown in FIG. 2 is omitted. In FIG. 4, illustration of a control portion 20 is omitted.

The unit 70 is provided with a first frame 701, a second frame 702, a printing mechanism 71 and the cutting mechanism 80. The first frame 701 is a plate-shaped metal frame that extends in the front-rear and left-right directions and is disposed below the cassette mounting portion 8 (refer to FIG. 1). The printing mechanism 71 is a mechanism for printing characters on the tape and is disposed on the first frame 701. The printing mechanism 71 includes the head holder 74, the thermal head 10 (refer to FIG. 2), the platen holder 12, the platen roller 15, the movable feed roller 14, the ribbon take-up shaft 95, the tape drive shaft 100, a tape drive motor 711 and gears 715 to 723 etc.

The tape drive motor 711 and the control portion 20 are disposed below the first frame 701. A drive shaft 713 of the tape drive motor 711 protrudes to the upper side of the first frame 701 via a hole (not shown in the drawings) that is provided in the first frame 701. The gear 715 is fixed to the drive shaft 713 above the first frame 701. The gear 715 meshes with the gear 716. The gear 717 meshes with the gear 716 and the gear 718. The gear 719 meshes with the gear 718, the gear 720 and the gear 721. The ribbon take-up shaft 95 is provided in a standing manner on the top surface of the gear 717. The tape drive shaft 100 is provided in a standing manner on the top surface of the gear 720.

The control portion 20 is an electrical substrate that has a CPU, a ROM and a RAM etc. The control portion 20 controls various operations of the printer 1 by causing the CPU to execute programs stored in the ROM.

The second frame 702 is a plate-shaped metal frame that extends in the front-rear and left-right directions, and is screwed to the left side of the first frame 701. The second frame 702 is disposed below the tape discharge portion 110 (refer to FIG. 1). The second frame 702 has a support plate 730 that extends upward from the left end of the second frame 702. The cutting mechanism 80 is disposed on the second frame 702. The cutting mechanism 80 is a mechanism that is configured to cut the printed tape. An attachment plate 731, which extends to the right from the support plate 730, is provided on an upper end portion of the support plate 730. A motor 90, which will be explained later, is fixed to the right surface of the attachment plate 731.

Overview of Operations of Printer 1

An overview of the operations of the printer 1 will be explained with reference to FIG. 2. In the example shown in FIG. 2, the receptor type tape cassette 30 is mounted in the cassette mounting portion 8. In this case, when the platen holder 12 moves to the printing position, the platen roller 15 presses the thermal head 10 via the print tape 57 and the ink ribbon 60. At the same time, the movable feed roller 14 presses the tape drive roller 46 via the print tape 57.

The control portion 20 (refer to FIG. 3) drives the tape drive motor 711 (refer to FIG. 4) at the same time as executing the printing operation. The driven tape drive motor 711 rotates the ribbon take-up shaft 95, the tape drive shaft 100, the movable feed roller 14 and the platen roller 15 via the gears 715 to 723 (refer to FIG. 3). The unused ink ribbon 60 is pulled out from the ribbon spool 42 by the ribbon take-up shaft 95 rotating the ribbon take-up spool 44. The print tape 57 that is clamped between the tape drive roller 46 and the movable feed roller 14 is fed by the tape drive shaft 100 rotating the tape drive roller 46, and the unused print tape 57 is pulled out from the first tape spool 40.

In a section between the platen roller 15 and the thermal head 10, the thermal head 10 uses the unused ink ribbon 60 to perform printing on the print layer of the unused print tape 57. The printed print tape 57 is fed to the tape discharge portion 110 and is cut by the cutting mechanism 80 (refer to FIG. 3) that will be explained later. The cut print tape 57 is discharged from the discharge port 111.

Overview of Structure of Cutting Mechanism 80

The cutting mechanism 80 will be explained with reference to FIG. 3 to FIG. 10. In the following explanation, for expediency, the upper left side, the lower right side, the upper right side, the lower left side, the upper side and the lower side in FIG. 3 respectively correspond to the front side, the rear side, the left side, the right side, the upper side and the lower side of the cutting mechanism 80. For ease of understanding, an extension spring 230 has been omitted from FIG. 5. The extension spring 230 and an extension spring 330 have been omitted from FIG. 6. A half-cut mechanism 200 and the extension spring 330 have been omitted from FIG. 7. The half-cut mechanism 200 and a full-cut mechanism 300 have been omitted from FIG. 8. The upper left side and the lower right side in FIG. 10 respectively correspond to the lower side and the upper side of the cutting mechanism 80.

Figure 5:
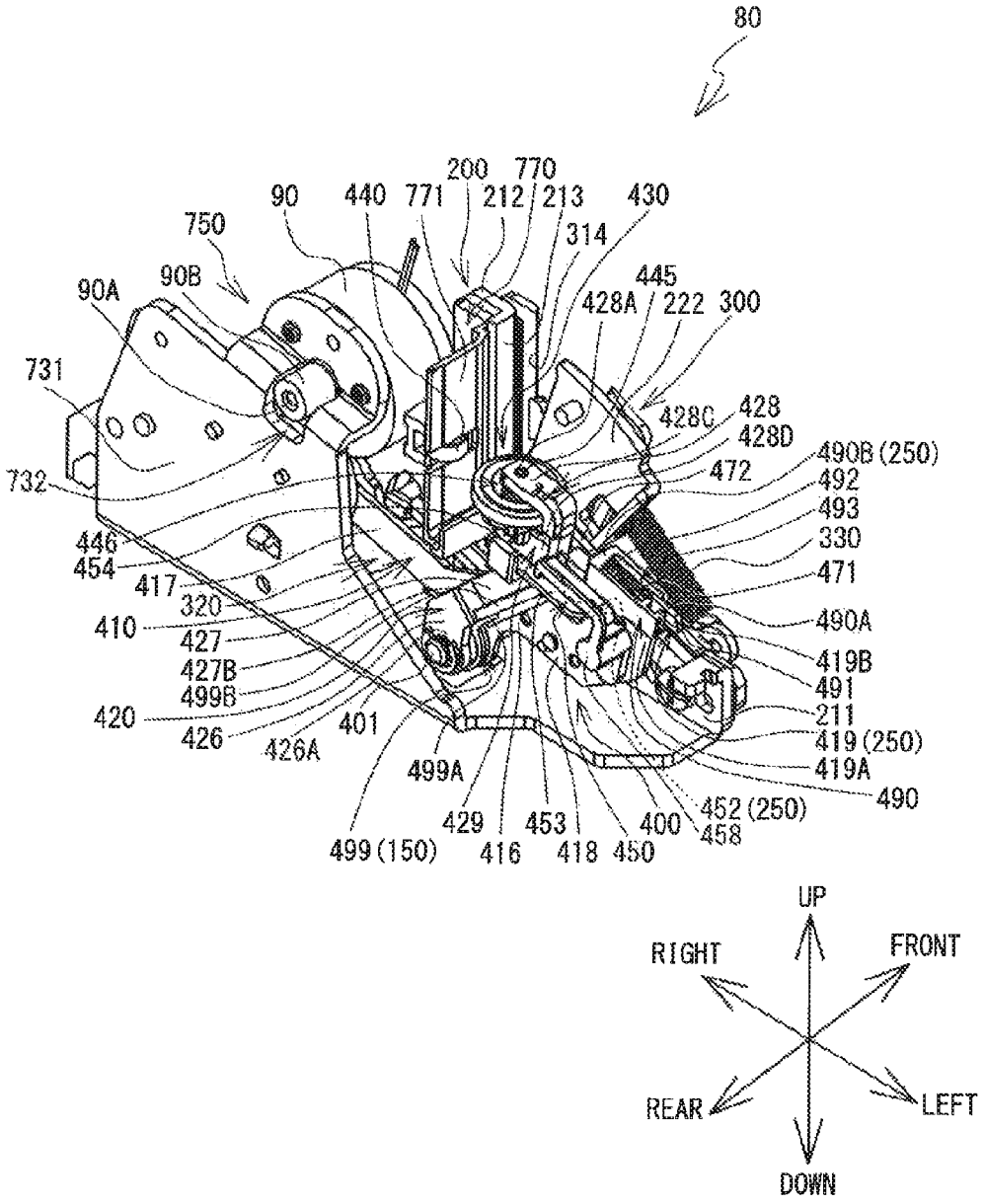
FIG. 5 is a perspective view of a cutting mechanism in a standby state, as seen from diagonally to the rear.

As shown in FIG. 3 to FIG. 5, the cutting mechanism 80 includes a drive mechanism 750, the half-cut mechanism 200, the full-cut mechanism 300, a feed mechanism 400, and the like. The drive mechanism 750 is disposed to the right of the tape discharge portion 110 (refer to FIG. 1). In the interior of the tape discharge portion 110, the full-cut mechanism 300, the half-cut mechanism 200, and the feed mechanism 400 are disposed in that order from the upstream side (the front side) to the downstream side (the rear side) of the feed path for the tape.

Figure 6:
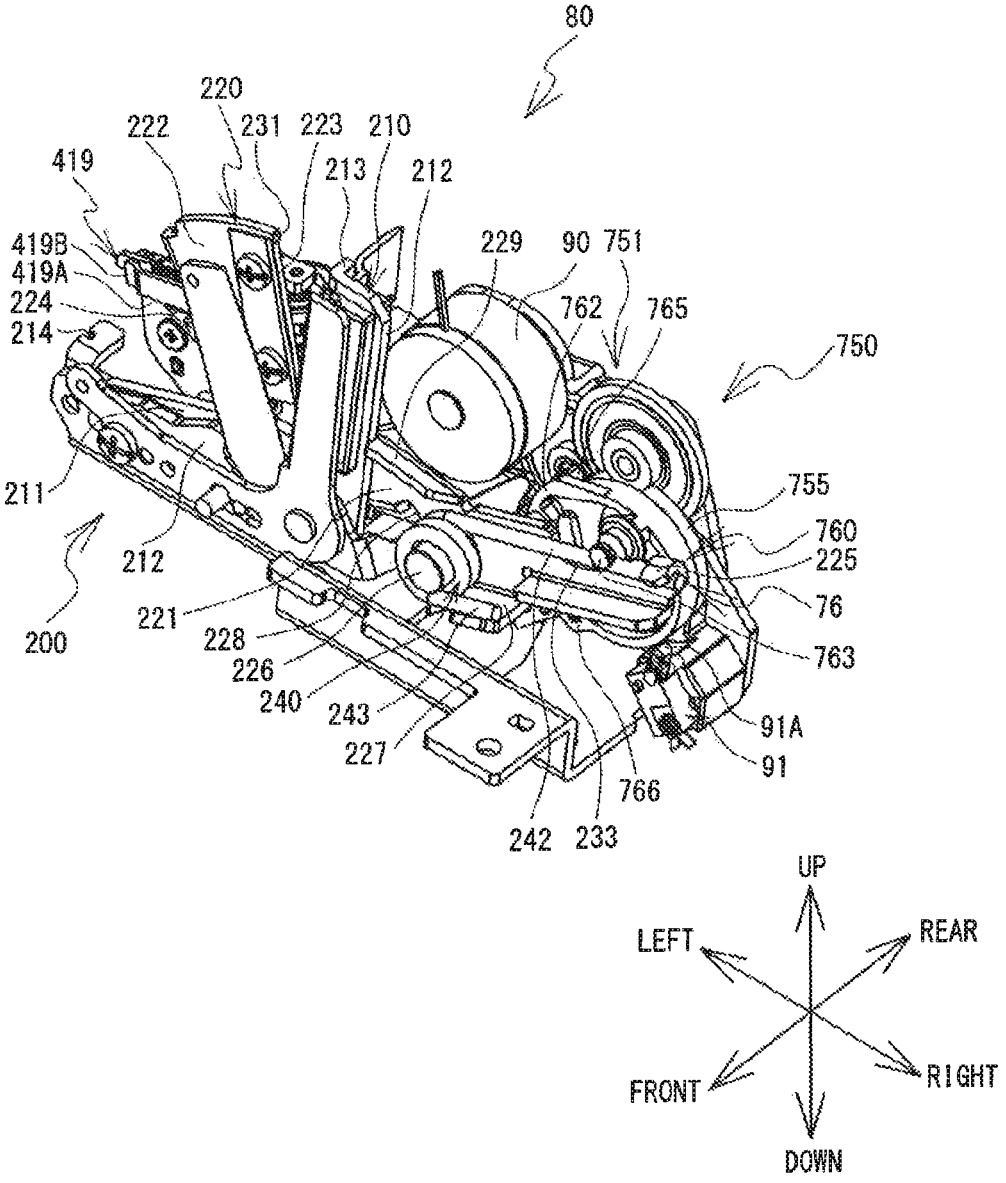
FIG. 6 is a perspective view of the cutting mechanism in the standby state, as seen from diagonally to the front.
Figure 7:
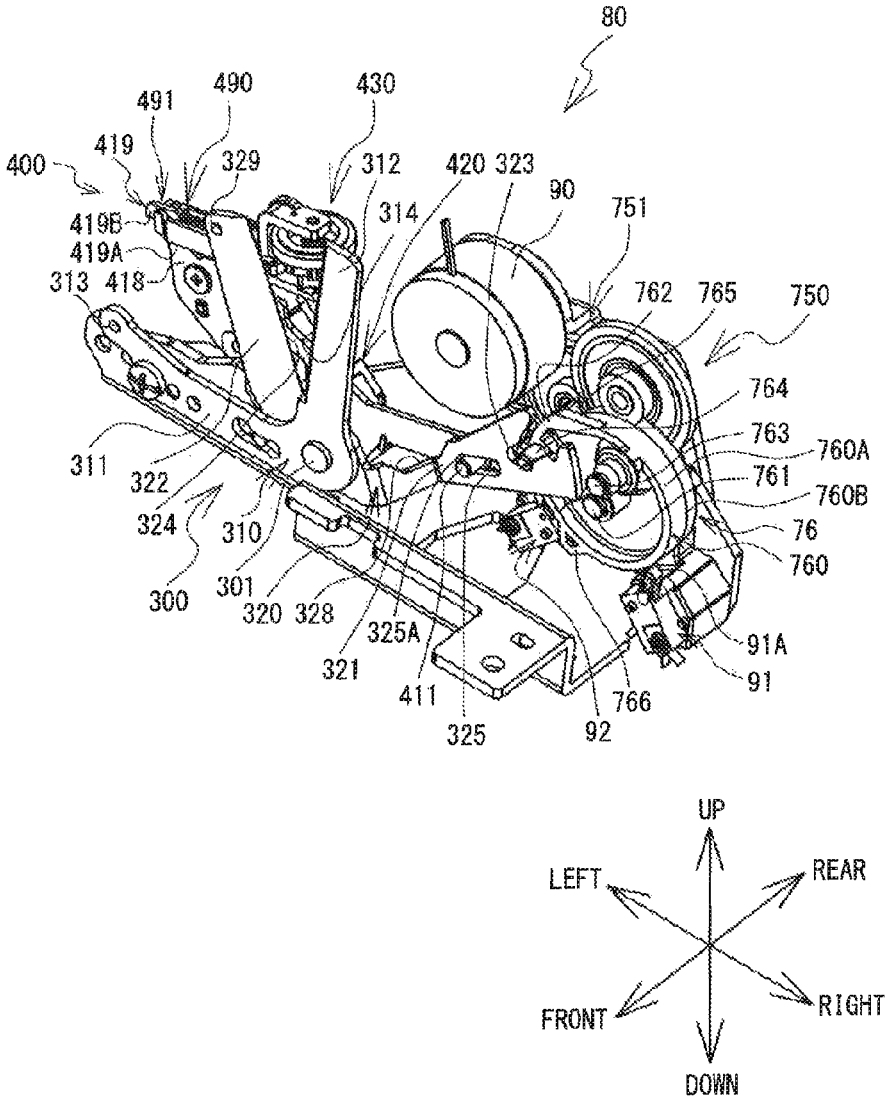
FIG. 7 is a perspective view of a full-cut mechanism in a standby state, as seen from diagonally to the front.

The drive mechanism 750 is a mechanism for driving the half-cut mechanism 200, the full-cut mechanism 300, and the feed mechanism 400. As shown in FIG. 6 and FIG. 7, the drive mechanism 750 includes the motor 90, a gear cluster 751, a gear cam 76, and the like. The motor 90 is affixed to the upper edge of the attachment plate 731, approximately in the center of the left-right direction. A gear 90B is affixed to an output shaft 90A of the motor 90 (refer to FIG. 5). The gear 90B is disposed on the inner side of an opening 732 that extends through the attachment plate 731. The gear cluster 751 is a plurality of gears that are provided on the front side of the attachment plate 731 such that they can rotate, and the gear cluster 751 is coupled to the gear 90B and a gear 755 that will be described later.

Figure 8:
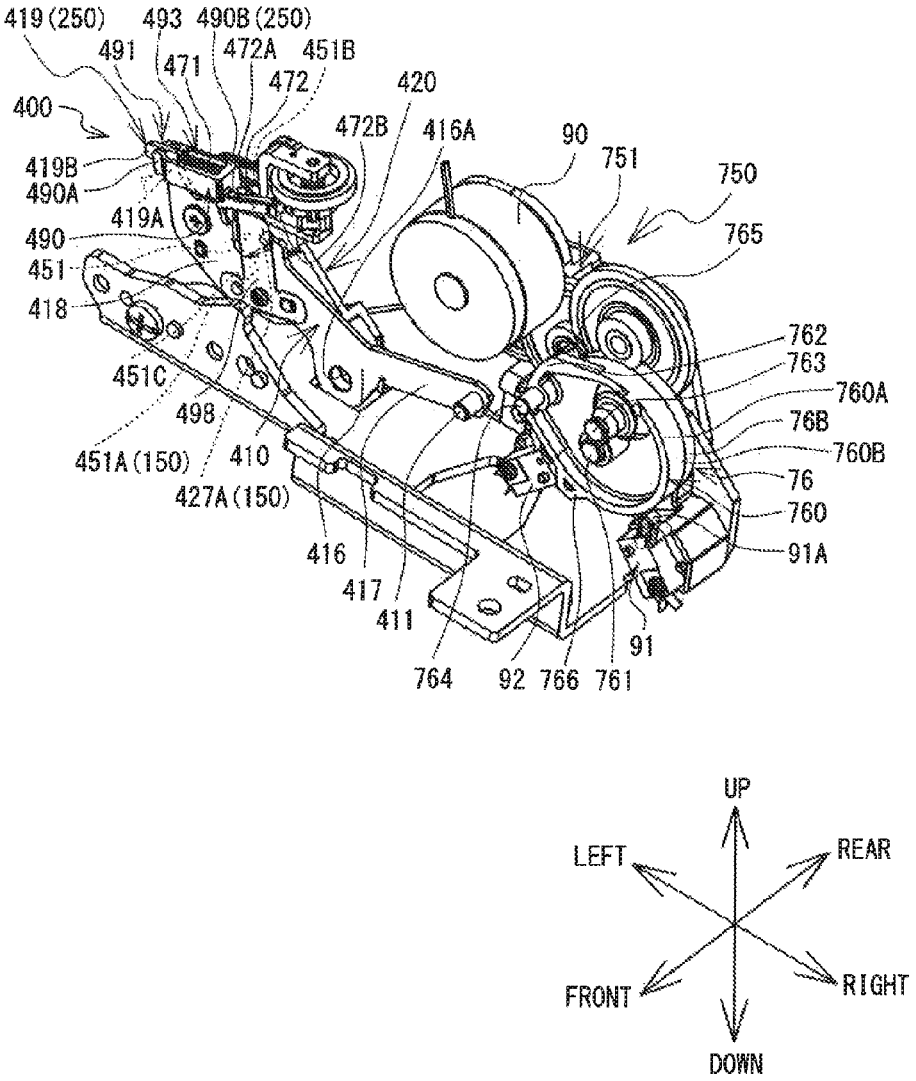
FIG. 8 is a perspective view of a feed mechanism in a standby state, as seen from diagonally to the front.

As shown in FIG. 6 to FIG. 8, the gear cam 76 is configured to rotate around a shaft portion 761 that extends toward the front from the attachment plate 731. The gear cam 76 includes the gear 755 and a cam plate 760. The gear 755 forms a rear side portion of the gear cam 76. The cam plate 760 forms a front side portion of the gear cam 76. Apart from a protruding portion 762, the distance from the shaft portion 761 to a peripheral surface of the cam plate 760 (namely, the radius of the cam plate 760) is substantially uniform. The protruding portion 762 is a portion of the cam plate 760 that protrudes to the outside in the radial direction.

A first drive pin 763, a second drive pin 764, a first detection plate 765 and a second detection plate 766 are provided on the cam plate 760. Each of the first drive pin 763 and the second drive pin 764 is a circular column that protrudes to the front from the cam plate 760. More specifically, the second drive pin 764 protrudes to the front from the protruding portion 762. The first drive pin 763 protrudes to the front from an outer edge portion of the cam plate 760 that is different from the protruding portion 762. In a front view, the first drive pin 763 is provided in a position that is approximately 90 degrees in the clockwise direction from the second drive pin 764, with the vertex of the angle at the shaft portion 761.

The cam plate 760 includes a front peripheral surface 760A and a rear peripheral surface 760B. The front peripheral surface 760A is a peripheral surface of the cam plate 760 that is on the front side of substantially the center of the cam plate 760 in the front-rear direction. The rear peripheral surface 760B is a peripheral surface that is on the rear side of substantially the center of the cam plate 760 in the front-rear direction. The first detection plate 765 is provided on the rear peripheral surface 760B. The second detection plate 766 is provided on the front peripheral surface 760A. Each of the first detection plate 765 and the second detection plate 766 is a plate-shaped body that protrudes to the outside in the radial direction from the cam plate 760. In a front view, the first detection plate 765 extends clockwise around the shaft portion 761 from the rear side of the protruding portion 762. In a front view, the second detection plate 766 is provided in a position that is approximately 90 degrees in the counterclockwise direction from the protruding portion 762, with the vertex of the angle at the shaft portion 761.

As shown in FIG. 7 and FIG. 8, two detection sensors 91 and 92 that are mechanical sensors are provided below the cam plate 760. The detection sensor 91 is provided below the right end portion of the cam plate 760. The detection sensor 92 is provided below the left end portion of the cam plate 760. The detection sensors 91 and 92 respectively have movable pins 91A and 92A (refer to FIG. 14) that extend upward from rotating shafts (not shown in the drawings) that extend in the front-rear direction. The movable pin 91A is positioned below the front peripheral surface 760A, and the movable pin 92A is positioned below the rear peripheral surface 760B.

When the movable pin 91A is in a steady state in which it extends upward, the detection sensor 91 outputs an OFF signal. When the movable pin 91A is in a tilted state in which it has rotated in the clockwise direction from the steady state in a front view, the detection sensor 91 outputs an ON signal. When the movable pin 92A is in a steady state in which it extends upward, the detection sensor 92 outputs an OFF signal. When the movable pin 92A is in a tilted state in which it has rotated in the counterclockwise direction from the steady state in a front view, the detection sensor 92 outputs an ON signal.

Overview of Structure of Half-Cut Mechanism 200

The half-cut mechanism 200 will be explained with reference to FIG. 6. The half-cut mechanism 200 is a mechanism that is configured to cut only part of layers of the tape in which a plurality of layers are laminated. The half-cut mechanism 200 includes a fixed portion 210, a movable portion 220, the extension spring 230 (refer to FIG. 11), and a compression spring 240.

The fixed portion 210 is a plate-shaped member that is substantially L-shaped in a rear view and includes a first plate portion 211, a second plate portion 212, and a receiving base 213. The first plate portion 211 is a plate-shaped portion that extends in the left-right direction and is fixed to the second frame 702 (refer to FIG. 3). The second plate portion 212 is a plate-shaped portion that extends upward from the right end portion of the first plate portion 211. The receiving base 213 is a plate-shaped portion that protrudes to the rear from a portion of the left edge of the second plate portion 212 that is above the center of the second plate portion 212 in the up-down direction. The receiving base 213 extends in parallel to the front-rear direction and to the up-down direction.

The movable portion 220 is a plate-shaped member that is substantially L-shaped in a front view and is configured to rotate around a rotating shaft (not shown in the drawings) that extends in the front-rear direction. The movable portion 220 is disposed to the rear of the second plate portion 212 and in front of the cam plate 760. The movable portion 220 includes a first plate portion 221, a second plate portion 222, a cutting blade 223, and a gap forming portion 231. The first plate portion 221 is a plate-shaped portion that extends approximately in the left-right direction and extends from the lower side of the receiving base 213 to the right side of the cam plate 760. The second plate portion 222 is a plate-shaped portion that extends upward from the left end portion of the first plate portion 221 such that it is inclined at a substantially 90-degree angle with respect to the first plate portion 221. The second plate portion 222 is disposed to the left of the receiving base 213.

The cutting blade 223 is a blade that is attached to the front face of the second plate portion 222 and that extends along the right edge portion of the second plate portion 222. The cutting blade 223 faces the receiving base 213 from the left side. The gap forming portion 231 is a protruding portion with a substantially three-dimensional rectangular shape that protrudes from the upper side of the cutting blade 223 and protrudes slightly more toward the receiving base 213 than the cutting blade 223.

Latching plates 225, 227, and 229, a spring shaft portion 226, an escape groove 228, and a guide groove 233 are provided in the first plate portion 221. The spring shaft portion 226 extends to the front from the first plate portion 221, between the second plate portion 212 and the cam plate 760 in a front view. The latching plates 225, 227, and 229 are all protruding pieces that protrude to the front from the first plate portion 221. The latching plate 225 protrudes to the front from the upper right end portion of the first plate portion 221. The latching plate 227 protrudes to the front from the lower side of the spring shaft portion 226. The latching plate 229 protrudes to the front from the upper side of the spring shaft portion 226 and the right side of the second plate portion 212. The escape groove 228 is a groove portion that is recessed upward from the lower edge portion of the first plate portion 221 and is provided between the second plate portion 212 and the spring shaft portion 226 in a front view.

The compression spring 240 is a torsion coil spring that is held by the first plate portion 221. The spring shaft portion 226 is inserted into a coil portion of the compression spring 240. The compression spring 240 includes a pair of arm portions 242 and 243 that extend substantially in parallel from opposite sides of the coil portion. The leading end portion of the arm portion 242 is latched to the latching plate 225 by energizing the latching plate 225 from below. The leading end portion of the arm portion 243 is latched to the latching plate 227 by energizing the latching plate 227 from above.

The guide groove 233 is provided below the first drive pin 763 in a front view and is a groove portion that is recessed downward from an upper edge portion of the first plate portion 221. The guide groove 233 is recessed in an arc shape in a front view, to a position that is lower than the arm portion 242 that is latched to the latching plate 225.

A protruding piece 224 that protrudes toward the front (refer to FIG. 11) is provided on the left edge portion of the second plate portion 222. One end portion of the extension spring 230 (refer to FIG. 11) is provided on the protruding piece 224. The other end portion of the extension spring 230 is connected to an attachment hole 214 that is provided on the left end portion of the first plate portion 211. In a front view, the elastic force of the extension spring 230 energizes the second plate portion 222 in a counterclockwise direction around a support shaft (not shown in the drawings). In the position in which the latching plate 229 is latched to the second plate portion 212, the rotation of the second plate portion 222 is restricted. In this way, the movable portion 220 is held in a first retracted position in which the cutting blade 223 is separated from the receiving base 213.

Overview of Structure of Full-Cut Mechanism 300

The full-cut mechanism 300 will be explained with reference to FIG. 7. The full-cut mechanism 300 is a mechanism that is configured to cut all the layers of the tape in which the plurality of layers are laminated. The full-cut mechanism 300 includes a fixed portion 310, a movable portion 320, and the like.

The fixed portion 310 is a plate-shaped member that is substantially L-shaped in a rear view, and it is disposed in front of the fixed portion 210 (refer to FIG. 6). The fixed portion 310 includes a first plate portion 311, a second plate portion 312, and a fixed blade 314. The first plate portion 311 is a plate-shaped portion that extends in the left-right direction and is fixed to the second frame 702 (refer to FIG. 3 and FIG. 4). The second plate portion 312 is a plate-shaped portion that extends upward from the right end portion of the first plate portion 311. The portion where the first plate portion 311 and the second plate portion 312 are joined is fixed in place by a support shaft 301 that extends in the front-rear direction. The fixed blade 314 is a blade portion that is provided on the left edge portion of the second plate portion 312 and extends in the up-down direction.

The movable portion 320 is a plate-shaped member that is substantially L-shaped in a front view and can rotate around the support shaft 301. The movable portion 320 is disposed to the rear of the fixed portion 310 and in front of the cam plate 760. The movable portion 320 includes a first plate portion 321, a second plate portion 322, a movable blade 324, and the like. The first plate portion 321 is a plate-shaped portion that extends approximately in the left-right direction in a front view. More specifically, the first plate portion 321 is a plate-shaped portion that extends to the rear from the right side of the support shaft 301, passing underneath the escape groove 228 (refer to FIG. 6), and then extending such that it bends approximately to the right. The right end of the first plate portion 321 is disposed in front of the cam plate 760.

The second plate portion 322 is a plate-shaped portion that extends upward from the left end portion of the first plate portion 321 such that it is inclined at a substantially 90-degree angle with respect to the first plate portion 321. The support shaft 301 is inserted into a through-hole (not shown in the drawings) that is provided in the portion where the first plate portion 321 and the second plate portion 322 are joined. The movable blade 324 extends along a right edge portion of the second plate portion 322 and is a blade portion that faces the fixed blade 314 from the left side.

A guide groove 323, a guide hole 325 and an escape groove 328 are provided in the first plate portion 321. The guide groove 323 is a groove portion that is recessed downward from the upper edge portion of the first plate portion 321 and is provided on the right end portion of the first plate portion 321. The guide hole 325 is a hole that extends through the first plate portion 321 and is provided substantially in the center, in the lengthwise direction, of the first plate portion 321. The guide hole 325 is a long hole that extends approximately in parallel to the lengthwise direction of the first plate portion 321. The escape groove 328 is a groove portion that is provided in the left end portion of the first plate portion 321 and that is recessed downward from the upper edge portion of the first plate portion 321. The escape groove 328 is positioned below the escape groove 228 (refer to FIG. 6).

An attachment hole 329 is provided in the left end portion of the second plate portion 322. One end portion of the extension spring 330 (refer to FIG. 5) is provided in the attachment hole 329. The other end portion of the extension spring 330 is provided in an attachment hole 313 that is provided in the left end portion of the first plate portion 311. In a front view, the elastic force of the extension spring 330 energizes the second plate portion 322 in a counterclockwise direction around the support shaft 301. In this way, the movable portion 320 is held in a second retracted position in which the movable blade 324 is separated from the fixed blade 314.

Detailed Structure of Feed Mechanism 400

The feed mechanism 400 will be explained with reference to FIG. 5 and FIG. 8 to FIG. 10. The feed mechanism 400 is a mechanism for feeding the tape that has been cut by the full-cut mechanism 300 toward the discharge port 111 (refer to FIG. 1) and discharging the tape. As shown in FIG. 5, the feed mechanism 400 includes a guide member 770, a fixed roller 440, a shaft member 401, a first link 410, a second link 420, and a holding member 490.

The guide member 770 is a plate-shaped member that is attached to the rear face of the second plate portion 212. The guide member 770 includes a guide wall 771 that is a plate-shaped portion that extends in the front-rear direction and the up-down direction to the rear of the receiving base 213. The guide wall 771 is configured to guide the printed tape toward the discharge port 111.

The fixed roller 440 is provided on the guide member 770 and is a rotating body that is configured to rotate around a rotating shaft (not shown in the drawings) that extends in the up-down direction. The fixed roller 440 is provided to the rear of the receiving base 213. The shaft member 401 extends to the rear from the first plate portion 211. The shaft member 401 is disposed to the left of the guide wall 771 and below the second plate portion 222. Hereinafter, the clockwise direction around the shaft member 401 in a front view will be called the first direction. The opposite direction from the first direction will be called the second direction.

As shown in FIG. 5 and FIG. 8, the first link 410 is a plate-shaped member that is long substantially in the left-right direction and that is disposed to the rear of the movable portion 320 (refer to FIG. 7). The first link 410 is configured to pivot around the shaft member 401 in the first direction and the second direction. The first link 410 includes a connecting portion 416, a first plate portion 417, and a second plate portion 418. The connecting portion 416 is a plate-shaped portion that forms a portion that is approximately in the center of the left-right direction of the first link 410, and it is provided with a through-hole 416A, into which the shaft member 401 is inserted. The first plate portion 417 extends to the right from the connecting portion 416 and extends as far as the rear side of the guide hole 325 (refer to FIG. 7).

A pin 411 that protrudes to the front from the first link 410 is provided on the right end portion of the first plate portion 417. The pin 411 is inserted into the guide hole 325. The first link 410 is thus connected to the first plate portion 321 (refer to FIG. 7) and can pivot around the shaft member 401 in conjunction with the rotating of the movable portion 320 (refer to FIG. 7).

The second plate portion 418 extends upward and to the left from the left end portion of the connecting portion 416. The left end portion of the second plate portion 418 is disposed in a position that is lower than the fixed roller 440. The second plate portion 418 includes a protruding piece 419, a groove portion 451, a first restricting member 450, and the like. The protruding piece 419 is a plate-shaped portion that protrudes upward from the upper left end of the second plate portion 418. A connecting portion 419A is formed on the lower side portion of the protruding piece 419. A leading end portion 419B is formed on the upper side portion of the protruding piece 419. In a front view, the connecting portion 419A is a substantially rectangular plate-shaped portion whose long axis extends approximately in the up-down direction, and it is connected to the second plate portion 418. In a front view, the leading end portion 419B is a substantially rectangular plate-shaped portion whose long axis extends approximately in the left-right direction.

The groove portion 451 is a portion that is notched downward in a portion that is approximately in the center, in the left-right direction, of the upper edge portion of the second plate portion 418. The right side portion of the groove portion 451 is bounded by a wall portion 451A that is formed on the second plate portion 418. The wall portion 451A includes a contact face 451B and an inclined face 451C. The contact face 451B is a face that extends approximately downward from the upper edge portion of the second plate portion 418. The inclined face 451C is a face that extends obliquely downward to the left from the lower edge portion of the contact face 451B.

As shown in FIG. 5, the first restricting member 450 is a plate-shaped member that is supported by the first link 410 to the right of the protruding piece 419 on the upper edge portion of the second plate portion 418. The first restricting member 450 includes a support portion 452, an extension portion 453, and a restricting portion 454. The support portion 452 protrudes to the rear from the second plate portion 418. The extension portion 453 is disposed to the rear of the groove portion 451 (refer to FIG. 8) and extends approximately to the right from the rear edge portion of the support portion 452. The restricting portion 454 extends approximately to the front from the right end portion of the extension portion 453. The restricting portion 454 is substantially rectangular in a plan view and is disposed to the rear of the second plate portion 418.

A second restricting member 458 that protrudes to the rear from the first link 410 is supported on the rear face of the second plate portion 418. The second restricting member 458 extends approximately in a straight line from the left side of the first restricting member 450 to an area that is substantially in the center of the upper side of the extension portion 453 in the left-right direction.

The holding member 490 is a plate-shaped member that is a substantially rectangular frame in a plan view, and the part of it that is to the rear of its approximate midpoint in the front-rear direction is disposed on the support portion 452. This enables the holding member 490 to pivot in the first direction and the second direction around the shaft member 401. The holding member 490 is configured to slide in relation to the support portion 452. A gap 493 is formed on the inner side of the holding member 490. The protruding piece 419 advances into the gap 493 from below. In other words, the protruding piece 419 protrudes from the second plate portion 418 toward the holding member 490. The protruding piece 419 is disposed in the second direction from a right wall portion 490B of the holding member 490, and it faces the right wall portion 490B across the gap 493.

A groove portion 491 is provided on a left wall portion 490A of the holding member 490. The groove portion 491 is a portion that is recessed downward from the upper edge portion of the left wall portion 490A. The groove portion 491 is continuous with the gap 493. The leading end portion 419B is inserted into the groove portion 491 from above. The left side portion of the leading end portion 419B protrudes to the left from the groove portion 491.

A coil spring 471 is disposed in the gap 493 in a compressed state. The right end portion of the coil spring 471 is held by a pin (not shown in the drawings) that protrudes to the left from the right wall portion 490B. The left end portion of the coil spring 471 is held by the right side portion of the leading end portion 419B. The holding member 490 is energized to the right by the compressing of the coil spring 471.

As shown in FIG. 8, a pressing member 472 is supported on the right wall portion 490B. The pressing member 472 protrudes from the right wall portion 490B toward the opposite side from the coil spring 471. The pressing member 472 includes a wall portion 472A and a pressing portion 472B. The wall portion 472A extends in a straight line from the right wall portion 490B and is formed into a substantially three-dimensional rectangular shape. The rear side portion of the wall portion 472A comes into contact with a flat spring 498 that is affixed to the front face of the second plate portion 418. The pressing portion 472B forms the right end portion of the pressing member 472.

As shown in FIG. 5, the second link 420 is a plate-shaped member that is configured to pivot in the first direction and the second direction around the shaft member 401 to the rear of the first link 410. In other words, the first link 410 and the second link 420 are configured to pivot around the shaft member 401 in a state in which they are next to one another in the front-rear direction. The second link 420 includes a connecting portion 426, a plate portion 427, and an attaching portion 428. The connecting portion 426 is a plate-shaped portion that is long in the up-down direction, and it is provided with a through-hole 426A, through which the shaft member 401 is inserted. The plate portion 427 extends upward and to the left from the upper left portion of the connecting portion 426.

As shown in FIG. 8, a protruding portion 427A is provided on the upper portion of the front face of the plate portion 427. The protruding portion 427A is a circular columnar body that protrudes to the front from the second link 420 and that advances into the groove portion 451. In other words, the protruding portion 427A protrudes toward the first link 410 from the second link 420 and is disposed on the second direction side of the wall portion 451A.

As shown in FIG. 5, a wall portion 427B that protrudes toward the rear from the second link 420 is provided on the rear face of the plate portion 427. The wall portion 427B extends in parallel to the lengthwise direction of the plate portion 427. The wall portion 427B is energized in the first direction by a torsion spring 499. A coil portion of the torsion spring 499 is held by the shaft member 401 between the first link 410 and the second link 420.

The torsion spring 499 includes a pair of arm portions 499A and 499B that extend from opposite ends of the coil portion. The arm portion 499A latches to the lower edge portion of the first plate portion 417. The arm portion 499B latches to the end portion on the second direction side of the wall portion 427B. The energizing of the wall portion 427B in the first direction by the torsion spring 499 causes the protruding portion 427A (refer to FIG. 8) to latch to the contact face 451B (refer to FIG. 8) from the second direction side.

The attaching portion 428 is a plate-shaped portion that is substantially C-shaped in a front view and that is provided on the upper edge portion of the plate portion 427. The attaching portion 428 includes round holes 428A and 428B (refer to FIG. 4) whose shapes are the same. The round hole 428A extends approximately in the up-down direction through an upper wall portion 428C that forms the upper edge portion of the attaching portion 428. The round hole 428B extends approximately in the up-down direction through an lower wall portion 428D that forms the lower edge portion of the attaching portion 428 (refer to FIG. 4). The round holes 428A and 428B face one another across a gap 429 that is formed between the upper wall portion 428C and the lower wall portion 428D.

A movable roller 430 is disposed in the gap 429 and is supported by the second link 420. The movable roller 430 is a rotating body that, by operating in coordination with the fixed roller 440, feeds the tape that is guided by the guide wall 771. The movable roller 430 is capable of forward rotation around a rotational axis X (refer to FIG. 10) that extends through the centers of the round holes 428A and 428B. Forward rotation means rotation that, when the movable roller 430 is viewed from below, is clockwise around the rotational axis X. Reverse rotation of the movable roller 430, which the opposite of forward rotation, is prevented by a clutch spring 446 that will be described later.

The movable roller 430 is configured to move between a clamping position (refer to FIG. 12B) and a released position (refer to FIG. 12A) in conjunction with the pivoting of the second link 420. The clamping position is a position in which the movable roller 430 faces the fixed roller 440 from the left side, with the tape feed path (not shown in the drawings) between them. The released position is a position in which the movable roller 430 has moved in the second direction farther away from the fixed roller 440 than it was in the clamping position. When the movable roller 430 is in the clamping position, the movable roller 430 is able to feed the tape by clamping the tape against the fixed roller 440 and performing forward rotation.

Figure 9:
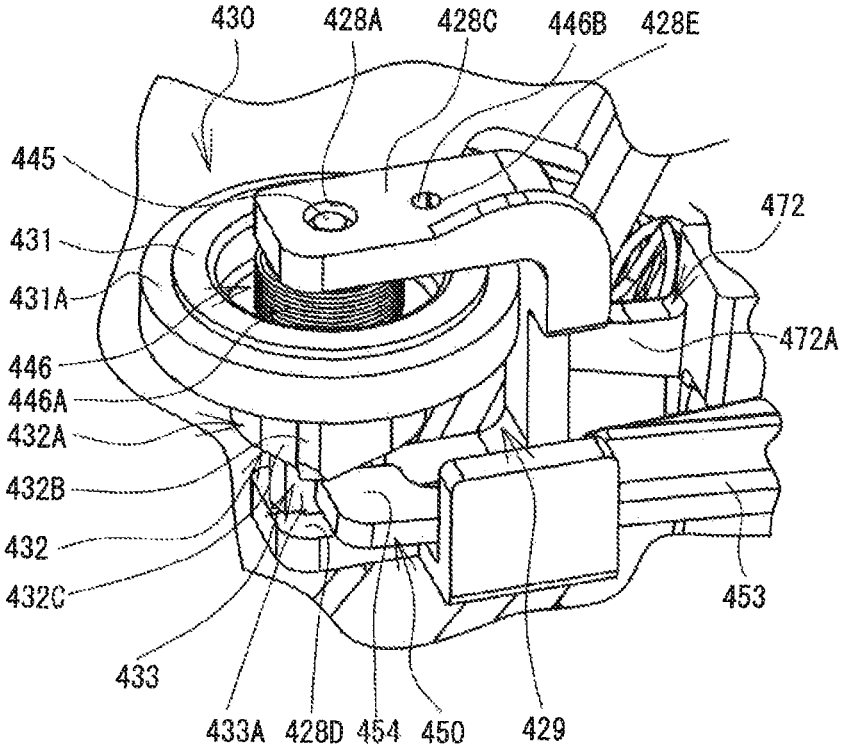
FIG. 9 is a perspective view of a movable roller, as seen from diagonally above.
Figure 10:
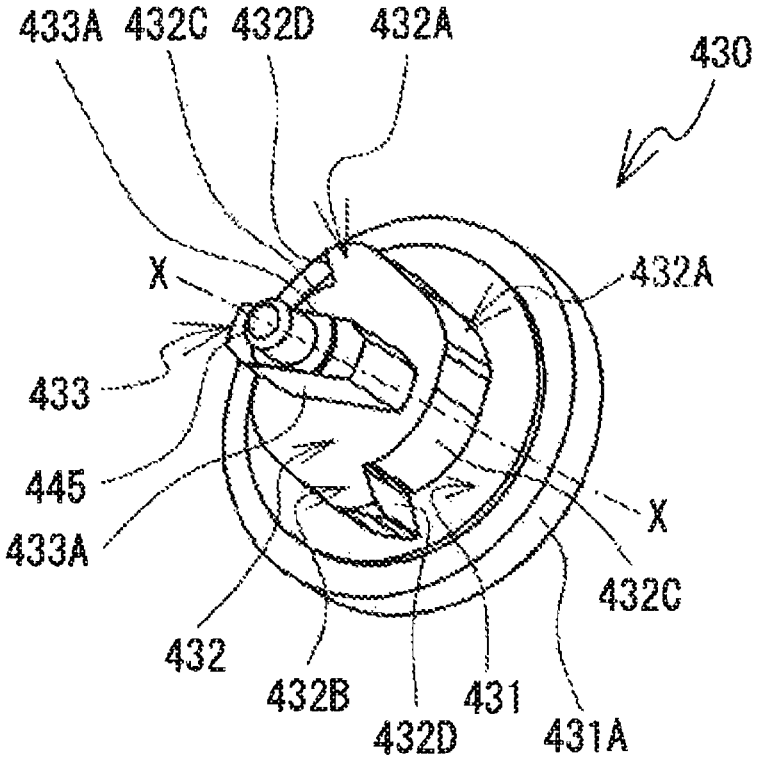
FIG. 10 is a perspective view of the movable roller, as seen from diagonally below.

As shown in FIG. 9 and FIG. 10, the movable roller 430 includes a rotating shaft 445, the clutch spring 446, a roller portion 431, a cam member 432, and a coupled portion 433. The rotating shaft 445 is a circular columnar shaft member that extends along the rotational axis X. The upper end portion of the rotating shaft 445 is rotatably attached to the round hole 428A. The lower end portion of the rotating shaft 445 is rotatably attached to the round hole 428B (refer to FIG. 4). The roller portion 431 has a circular tubular shape that extends slightly in parallel to the rotational axis X, its bottom being closed and its upper end being open. A rubber member 431A that is configured to come into contact with the tape is provided on the outer peripheral face of the roller portion 431.

The clutch spring 446 is disposed inside the roller portion 431. The clutch spring 446 is a one-way clutch and includes a coil portion 446A. The coil portion 446A is provided on the rotating shaft 445. An arm portion 446B that extends from the upper end portion of the coil portion 446A is attached to a through-hole 428E that extends through the upper wall portion 428C. An arm portion (not shown in the drawings) that extends from the lower end portion of the coil portion 446A is attached to the inner peripheral face of the roller portion 431. The clutch spring 446 prevents reverse rotation of the roller portion 431 while permitting forward rotation of the roller portion 431.

The cam member 432 is a substantially disc-shaped member that protrudes from the lower face of the roller portion 431 in a direction that is parallel to the rotational axis X, and it is capable of forward rotation around the rotational axis X together with the roller portion 431. The distance by which an outer peripheral portion 432A of the cam member 432 is separated from the rotational axis X varies along the direction of forward rotation.

The outer peripheral portion 432A includes two protruding portions 432B and two gradually increasing portions 432C. The two protruding portions 432B each protrude from the outer peripheral portion 432A in the direction away from the rotational axis X. The two protruding portions 432B are symmetrically disposed on opposite sides of the rotational axis X. Each of the two protruding portions 432B includes a contact portion 432D. The contact portion 432D is a flat portion that is formed on the side of the protruding portion 432B that faces in the direction of reverse rotation. The contact portion 432D extends in a direction that is substantially orthogonal to the rotational axis X.

The two gradually increasing portions 432C are each disposed on the movable roller 430 on the sides of the protruding portions 432B that face in the direction of reverse rotation. The distances of the gradually increasing portions 432C from the rotational axis X increase gradually along the reverse rotation direction.

The coupled portion 433 has a substantially three-dimensional rectangular shape that protrudes from the lower face of the cam member 432 in a direction that is parallel to the rotational axis X. The coupled portion 433 includes two flat portions 433A, which are flat. The two flat portions 433A face each other on opposite sides of the rotational axis X and extend in a direction that is parallel to the rotational axis X. The two flat portions 433A are disposed between the two protruding portions 432B.

Positional Relationships Among Members of the Feed Mechanism 400

The positional relationships among the movable roller 430, the first restricting member 450, the second restricting member 458, and the pressing member 472 will be explained with reference to FIG. 5, FIG. 9, FIG. 10, and FIG. 12A. Of the two flat portions 433A, the flat portion 433A that faces the rear is positioned opposite the front side of the restricting portion 454. Only a tiny gap exists between the rear-facing flat portion 433A and the restricting portion 454. In other words, the first restricting member 450 restricts the forward rotation of the movable roller 430 by advancing into a first rotation area. The first rotation area is a rotation area that the coupled portion 433 describes when it performs forward rotation.

Hereinafter, the position where the first restricting member 450 that has advanced into the first rotation area restricts the forward rotation of the movable roller 430 will be called the first restricting position. The first restricting member 450 that is in the first restricting position is able to move to a first permitting position (refer to FIG. 12E) in conjunction with the pivoting of the first link 410 in the first direction. The first permitting position is a position where the first restricting member 450 permits the forward rotation of the movable roller 430 by withdrawing from the first rotation area.

Figures 12A, 12B, 12C, 12D, 12E, 12F, 12G, 12H:
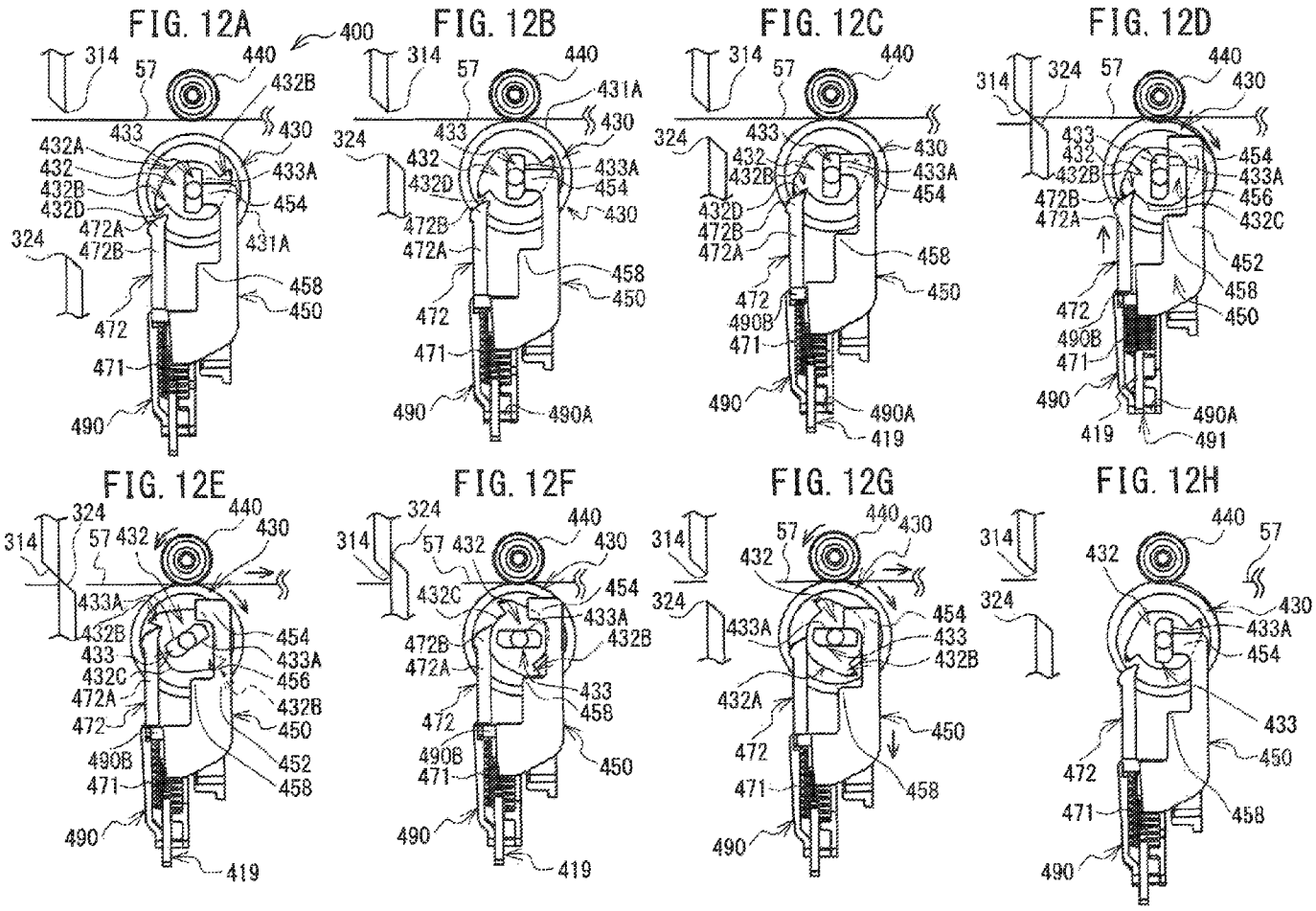
FIG. 12A to FIG. 12H are explanatory figures that show a flow in which a print tape is cut and discharged.

The second restricting member 458 is disposed in a position where it is separated from the left side of the one of the two contact portions 432D that faces the rear (refer to FIG. 10 and FIG. 12A). More specifically, the second restricting member 458 is disposed in a second permitting position. The second permitting position is a position where the second restricting member 458 has withdrawn to the opposite side of the rotational axis X from a second rotation area. The second rotation area is a rotation area that the two contact portions 432D describe when they perform forward rotation. The second restricting member 458 that has withdrawn from the second rotation area does not interfere with (permits) the forward rotation of the movable roller 430.

The second restricting member 458 that is in the second permitting position is able to move to a second restricting position (refer to FIG. 12D) in conjunction with the pivoting of the first link 410 in the first direction. The second restricting position is a position where the second restricting member 458 restricts the forward rotation of the movable roller 430 by advancing into the second rotation area.

The pressing member 472 is disposed in a position (hereinafter called the separated position) in which it is separated from the left side of the one of the two contact portions 432D that faces the front. The pressing member 472 that is in the separated position is able to move to a contact position (refer to FIG. 12D) in conjunction with the pivoting of the first link 410 in the first direction. The contact position is a position where the pressing member 472 comes into contact with and energizes the contact portion 432D. In the separated position, the pressing member 472 is farther away from the rotational axis X (refer to FIG. 10) than when it is in the contact position.

Standby State of the Cutting Mechanism 80

The cutting mechanism 80 that has been explained above is in a standby state (refer to FIG. 5 to FIG. 8, FIG. 12A, FIG. 13A) when the motor 90 is not being operated. When the cutting mechanism 80 is in the standby state, the movable portions 220 and 320 are in the first retracted position and the second retracted position, respectively, and the movable roller 430 is in the released position. Furthermore, the first restricting member 450 is in the first restricting position, the second restricting member 458 is in the first permitting position, and the pressing member 472 is in the separated position.

The gap between the fixed blade 314 and the movable blade 324, the gap between the receiving base 213 and the cutting blade 223, and the gap between the fixed roller 440 and the movable roller 430 are all continuous with one another in the front-rear direction. The tape feed path in the tape discharge portion 110 (refer to FIG. 1) runs through these gaps that are continuous in the front-rear direction. The printed tape is fed along the fixed blade 314, the receiving base 213, and the fixed roller 440.

As shown in FIG. 6 to FIG. 8, when the cutting mechanism 80 is in the standby state, the rotation position of the cam plate 760 is in a reference position where the protruding portion 762 faces to the left. When the cam plate 760 is in the reference position, the first drive pin 763 is positioned above the shaft portion 761. The second drive pin 764 is positioned to the left of the shaft portion 761. When the cam plate 760 is in the reference position, the movable pins 91A and 92A (refer to FIG. 14) are separated from the first detection plate 765 and the second detection plate 766, and the detection sensors 91 and 92 are in the OFF state.

When the cam plate 760 is in the reference position, the first drive pin 763 is above the first plate portion 221 of the half-cut mechanism 200. The first drive pin 763 is in contact from above with the arm portion 242 of the compression spring 240, which is latched to the latching plate 225. The second drive pin 764 extends to the front as far as the upper side of the first plate portion 321 of the full-cut mechanism 300 and is in contact with the guide groove 323 of the first plate portion 321 from above.

Operational Modes of Cutting Mechanism 80

Figure 13A:
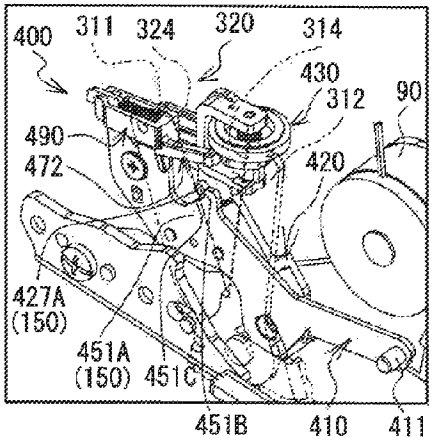
FIG. 13A to FIG. 13E are explanatory figures that show a flow in which the feed mechanism performs a discharge operation.
Figure 13B:
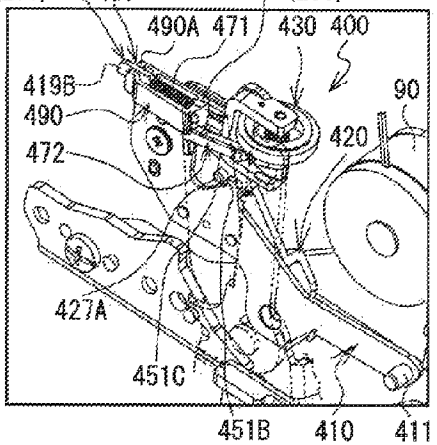
Figure 13C:
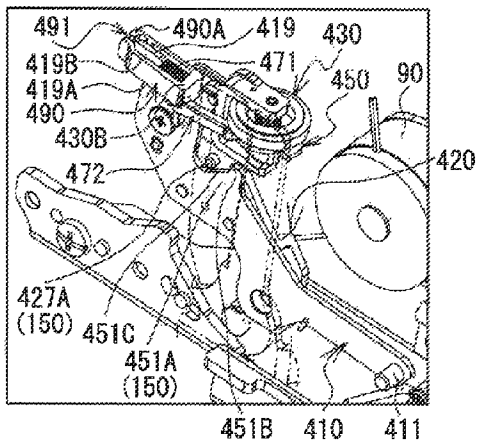
Figure 13D:
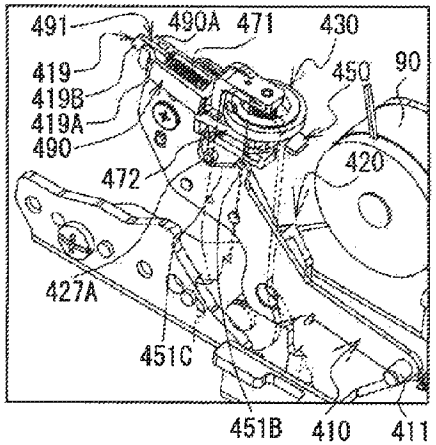
Figure 13E:
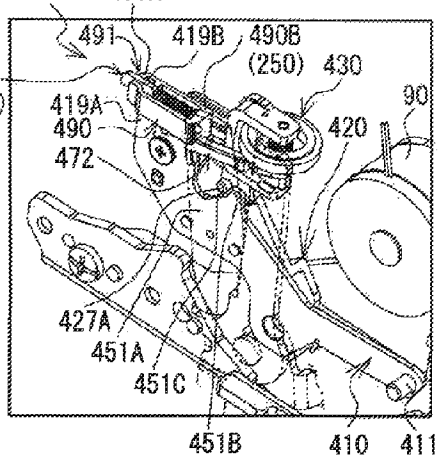
Figure 14:
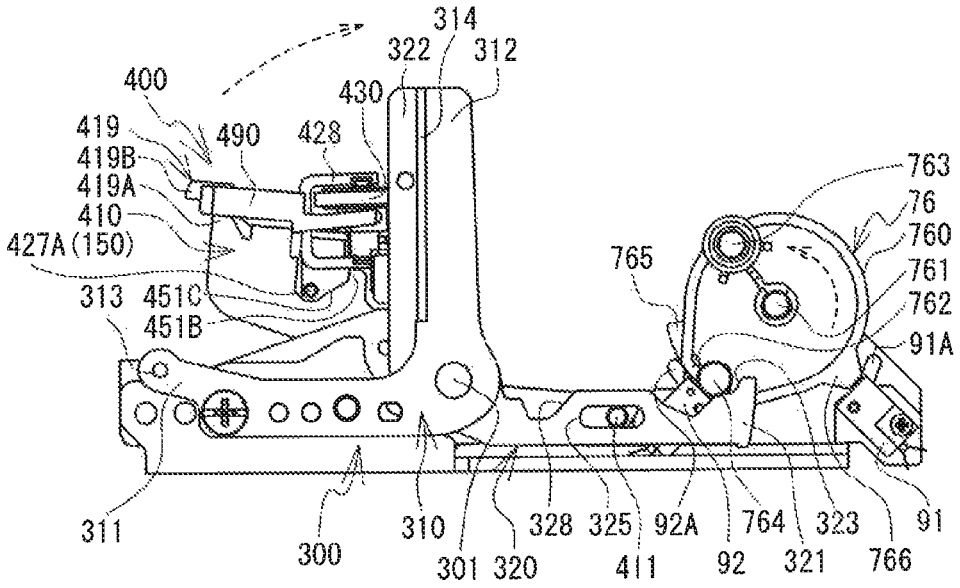
FIG. 14 is a front view of the full-cut mechanism when the cam plate is in a second displacing position.

Operational modes of the cutting mechanism 80 will be explained with reference to FIG. 6 to FIG. 8 and FIG. 11 to FIG. 14. In the explanation that follows, a case in which the printed print tape 57 (refer to FIG. 2) is cut will be used as an example. To facilitate understanding, FIG. 12A to FIG. 12H schematically show the cutting mechanism 80 as seen from below. FIG. 13A to FIG. 13E omit the flat spring 498, the fixed roller 440, and the guide member 770. FIG. 14 omits the extension spring 330. Note that FIG. 13A corresponds to FIG. 12A. FIG. 13B corresponds to FIG. 12B. FIG. 13C corresponds to FIG. 12D. FIG. 13D corresponds to FIG. 12E. FIG. 13E corresponds to FIG. 12G. The cutting mechanism 80 starts the cutting operation from the standby state (refer to FIG. 5 to FIG. 8, FIG. 12A).

Operational Modes of Half-Cut Mechanism 200

Figure 11:
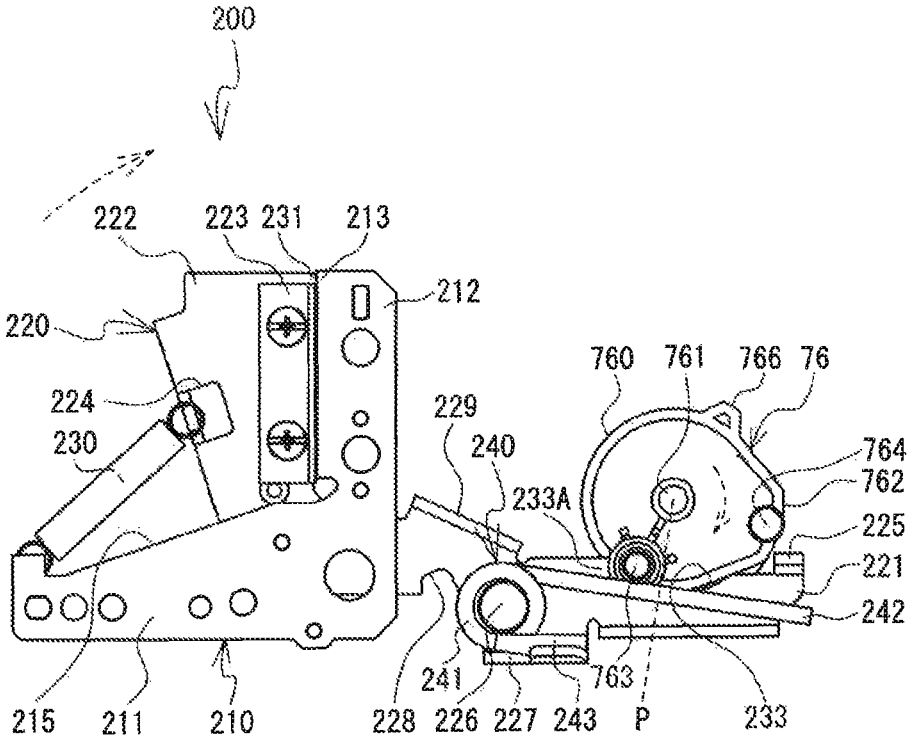
FIG. 11 is a front view of a half-cut mechanism when a cam plate is in a first displacing position.

Operational modes of the half-cut mechanism 200 will be explained with reference to FIG. 6 and FIG. 11. When the control portion 20 (refer to FIG. 3) causes the half-cut mechanism 200 to cut the print tape 57, the control portion 20 causes the motor 90 to turn in a first drive direction. The first drive direction is the counterclockwise direction around the output shaft 90A (refer to FIG. 5) in a rear view. When the motor 90 turns in the first drive direction, the cam plate 760, through the gear cluster 751, rotates in a first cutting direction. The first cutting direction is the clockwise direction around the shaft portion 761 in a front view. The first drive pin 763 rotates in the first cutting direction together with the cam plate 760.

When the first drive pin 763 rotates in the first cutting direction, it presses down on the arm portion 242, causing the movable portion 220 that is in the first retracted position to rotate clockwise in a front view against the elastic force of the extension spring 230. When the movable portion 220 rotates to the position where the first plate portion 221 comes into contact with the second frame 702 (refer to FIG. 3), the movable portion 220 moves from the first retracted position to a first cutting position. The first cutting position is a position where the gap forming portion 231 comes into contact with the receiving base 213 and the cutting blade 223 moves close to the receiving base 213. At this time, a gap is formed between the cutting blade 223 and the receiving base 213 that is approximately equal to the thickness of the release layer of the print tape 57 (refer to FIG. 1). The print tape 57 is clamped from the left and right sides by the cutting blade 223 and the receiving base 213.

Thereafter, the motor 90 turns farther in the first drive direction, causing the first drive pin 763 to rotate toward the left end portion of the guide groove 233 as it slides along the guide groove 233. The arm portion 242 is pressed farther down, and the movable portion 220 is energized in the clockwise direction in a front view. The cutting blade 223 presses the print tape 57 farther toward the receiving base 213, such that one of the layers (specifically, the print layer) of the print tape 57 is cut. In other words, the print tape 57 is half-cut.

Next, the motor 90 switches its operation and turns in a second drive direction. The second drive direction is a rotation direction of the motor 90 that is the opposite direction from the first drive direction. The cam plate 760 rotates in a second cutting direction, which is the opposite direction from the first cutting direction, and moves to the reference position. The movable portion 220 moves from the first cutting position to the first retracted position. The cutting mechanism 80 thus returns to the standby state.

After the cutting mechanism 80 has returned to the standby state, the control portion 20 operates the tape drive motor 711 (refer to FIG. 4) by a specified amount. The print tape 57, which has been half-cut (the print layer has been cut), is thus fed toward the discharge port 111.

The rotation control of the motor 90 by the control portion 20 in a case where the print tape 57 is half-cut will now be explained. The rotational position of the cam plate 760 that causes the movable portion 220 to move to the first cutting position will be called the first displacing position. When the cam plate 760, which was in the reference position, rotates to the first displacing position, the first detection plate 765 comes into contact with the movable pin 91A. The movable pin 91A changes from the steady state to the tilted state, causing the detection sensor 91 to change from the OFF state to the ON state. At this time, the movable pin 92A is not in contact with the protruding portion 762, so the detection sensor 92 (refer to FIG. 8) is held in the OFF state.

When the detection sensor 91 is in the ON state and the detection sensor 92 is in the OFF state, the control portion 20 determines that the cam plate 760 has rotated to the first displacing position. The control portion 20 causes the motor 90 to turn farther in the first drive direction by only a specified amount. The first drive pin 763 is thus moved to the left end portion of the guide groove 233, so the print tape 57 is reliably half-cut.

Operational Modes of Full-Cut Mechanism 300 and Feed Mechanism 400

Operational modes of the full-cut mechanism 300 and the feed mechanism 400 will be explained with reference to FIG. 7, FIG. 8, and FIG. 12A to FIG. 12H, and FIG. 14. The control portion 20 (refer to FIG. 3), by operating the tape drive motor 711 (refer to FIG. 4), feeds the printed print tape 57 to a point where it is between the movable blade 324 and the fixed blade 314 and between the fixed roller 440 and the movable roller 430. By causing the motor 90 to turn in the second drive direction, the control portion 20 causes the cam plate 760 to rotate away from the reference position in the second cutting direction.

As shown in FIG. 7 and FIG. 14, the second drive pin 764, when it rotates in the second cutting direction, energizes the first plate portion 321 downward at the guide groove 323. As the first plate portion 321 moves downward, the movable portion 320 rotates around the support shaft 301 in the clockwise direction in a front view, against the elastic force of the extension spring 330 (refer to FIG. 5).

The pin 411 moves approximately leftward along the guide hole 325, which rotates together with the movable portion 320. In this way, the first link 410 pivots in the first direction. The protruding portion 427A is latched to the contact face 451B by the elastic force of the torsion spring 499 (refer to FIG. 5), so the second link 420 pivots in the first direction together with the first link 410.

In other words, the second link 420 is made to pivot in the first direction together with the first link 410 by the torsion spring 499, the protruding portion 427A, and the wall portion 451A. Hereinafter, the torsion spring 499, the protruding portion 427A, and the wall portion 451A will be collectively called the coupling mechanism 150. At this time, the holding member 490, which is supported by the support portion 452, pivots in the first direction together with the first link 410.

The first restricting member 450 and the second restricting member 458 pivot in the first direction in conjunction with the pivoting of the first link 410. The movable roller 430, which is in the released position, moves in the first direction in conjunction with the sliding of the second link 420. The pressing member 472 moves in the first direction in conjunction with the pivoting of the holding member 490.

Because the first link 410, the second link 420, and the holding member 490 pivot together in the first direction, the positions of the movable roller 430, the first restricting member 450, the second restricting member 458, and the pressing member 472 in relation to one another do not change. In other words, the state in which the first restricting member 450 is in the first restricting position, the state in which the second restricting member 458 is in the second permitting position, the state in which the pressing member 472 is in the separated position are all maintained.

As shown in FIG. 12B and FIG. 13B, the movable roller 430, when it moves in the first direction, moves to the clamping position, where it clamps the print tape 57 from the side that is opposite the fixed roller 440. In the clamping position, the rubber member 431A comes into contact with the print tape 57. At this time, the movable blade 324 is in a position where it is separated from the fixed blade 314.

The turning of the motor 90 farther in the second drive direction causes the movable portion 320 to rotate farther in the clockwise direction in a front view and causes the movable blade 324 to move toward the fixed blade 314. The first link 410 pivots farther in the first direction in conjunction with the rotating of the movable portion 320.

In contrast, the pivoting of the second link 420 in the first direction is restricted by the fixed roller 440, which faces the movable roller 430 that is in the clamping position. The first link 410 pivots in the first direction while moving the wall portion 451A in relation to the protruding portion 427A (refer to FIG. 8). More specifically, the first link 410 pivots in the first direction independently of the second link 420, while keeping the inclined face 451C along the protruding portion 427A.

In other words, the coupling mechanism 150 pivots the first link 410 in the first direction independently of the second link 420, which moves the movable roller 430 to the clamping position. Due to the energizing force of the torsion spring 499, the second link 420 maintains the state in which the movable roller 430 is in the clamping position. At this time, the holding member 490, which is resting on the support portion 452, pivots in the first direction together with the first link 410.

As shown in FIG. 12C, the pivoting of the first link 410 and the holding member 490 in the first direction causes the first restricting member 450, the second restricting member 458, and the pressing member 472 to each move in the first direction. First, the pressing portion 472B of the pressing member 472 moves to the contact position, where it comes into contact with the contact portion 432D. At this time, the state in which the first restricting member 450 is in the first restricting position and the state in which the second restricting member 458 is in the second permitting position are maintained. The two gradually increasing portions 432C are separated from the wall portion 472A. The movable blade 324 is separated from the fixed blade 314.

The first restricting member 450 is in the first restricting position, so the forward rotation of the movable roller 430 is restricted, even though the pressing member 472 is in contact with the contact portion 432D. Therefore, the holding member 490, which has moved the pressing member 472 to the contact position, is restricted from pivoting in the first direction by the contact portion 432D.

The turning of the motor 90 farther in the second drive direction causes the movable portion 320 to rotate farther in the clockwise direction in a front view and causes the first link 410 to pivot farther in the first direction. In conjunction with the pivoting of the first link 410, the support portion 452 (refer to FIG. 5) moves in the first direction while sliding in relation to the holding member 490. The protruding piece 419 moves toward the right wall portion 490B while compressing the coil spring 471. The connecting portion 419A moves to the right, away from the left wall portion 490A.

In this manner, the first link 410 pivots in the first direction independently of the holding member 490. In other words, the first link 410 is made to pivot the first restricting member 450 and the second restricting member 458 in the first direction independently of the holding member 490 by the support portion 452, the protruding piece 419, and the right wall portion 490B. Hereinafter, the support portion 452, the protruding piece 419, and the right wall portion 490B will be collectively called the coupling mechanism 250.

Note that the coil spring 471, which has been compressed by the protruding piece 419, energizes the protruding portion 432B in the direction of forward rotation through the pressing member 472, which in the contact position. At this time, the forward rotation of the movable roller 430, which is energized by the coil spring 471, is restricted by the first restricting member 450, which is in the first restricting position. The movable blade 324 is in a position where it is close to the fixed blade 314.

As shown in FIG. 12D, FIG. 13B, and FIG. 14, the turning of the motor 90 farther in the second drive direction causes the movable blade 324 to move to a second cutting position. The second cutting position is a position where the movable blade 324 clamps the print tape 57 against the fixed blade 314 and cuts the print tape 57. That is, the print tape 57 is fully cut. At this time, while the first restricting member 450 remains in the first restricting position, the second restricting member 458 moves to the second restricting position. The coil spring 471 is compressed further as the protruding piece 419 moves farther toward the right wall portion 490B. The second restricting member 458, which is in the second restricting position, faces the protruding portion 432B on the rear side from the left.

As shown in FIG. 12E and FIG. 13D, the turning of the motor 90 farther in the second drive direction causes the movable blade 324 to rotate through the second cutting position in the clockwise direction in a front view, and causes the first link 410 to pivot farther in the first direction. The first restricting member 450 thus moves to the first permitting position. When the first restricting member 450 is in the first permitting position, a gap 456 advances into the first rotation area. The gap 456 is a recessed portion of the first restricting member 450 that is formed between the restricting portion 454 and the support portion 452. At this time, the movable roller 430 enters a state in which it is capable of forward rotation within the gap 456.

The pressing member 472, which is energized by the coil spring 471, presses against the contact portion 432D, causing the movable roller 430 to rotate forward by one-fourth of a revolution. The forward rotating movable roller 430 operates in coordination with the fixed roller 440 to feed the print tape 57 that has been cut. This forward rotation of the movable roller 430 will be called the first forward rotation. In conjunction with the first forward rotation of the movable roller 430, the pressing member 472 is moved to the right by the energizing force of the coil spring 471. At this time, the holding member 490 moves to the right along the support portion 452 (refer to FIG. 5). The pressing member 472 and the holding member 490 stop in the position where the left wall portion 490A latches to the connecting portion 419A.

As shown in FIG. 12F, the gradually increasing portion 432C rotates forward, sliding along the rear side portion of the wall portion 472A, which has moved. The forward rotation of the movable roller 430 is decelerated by the sliding friction that arises between the wall portion 472A and the gradually increasing portion 432C, such that the first forward rotation stops. The rotational position of the movable roller 430 when the first forward rotation ends will be called the specific rotational position. When the movable roller 430 is in the specific rotational position, the direction in which the two flat portions 433A extend is substantially orthogonal to the direction of the movement of the first restricting member 450.

When the first forward rotation ends, the protruding portion 432B on the rear side comes into contact with the second restricting member 458, which is in the second restricting position. The movable roller 430, which is in the specific rotational position, is restricted from rotating forward by the second restricting member 458 that is in the second restricting position, and it is prevented from rotating in reverse by the clutch spring 446 (refer to FIG. 9). The first forward rotation also causes the coupled portion 433 to change from a state in which it extends in the left-right direction in a bottom view to a state in which it extends in the front-rear direction. This causes the rear edge portion of the coupled portion 433 to be disposed inside the gap 456.

Note that in a case where, for example, the movable roller 430 has tilted away from its proper orientation during the first forward rotation, it may happen that the gradually increasing portion 432C and the wall portion 472A do not come into contact, or that the sliding friction that arises between the gradually increasing portion 432C and the wall portion 472A will be smaller. In that case, the first forward rotation of the movable roller 430 is stopped at the specific rotational position by the contact that occurs between the protruding portion 432B on the rear side and the second restricting member 458, which is in the second restricting position.

After the movable roller 430 has stopped at the specific rotational position, the motor 90 switches operation and turns in the first drive direction. The second drive pin 764, which is in contact with the guide groove 323, rotates in the first cutting direction (refer to FIG. 7 and FIG. 14). The movable portion 320 is rotated in the counterclockwise direction in a front view (refer to FIG. 7) by the energizing force of the extension spring 330 (refer to FIG. 5). In conjunction with the rotating of the movable portion 320, the pin 411 moves approximately rightward along the guide hole 325.

Accordingly, the first link 410 pivots in the second direction (refer to FIG. 8) as the inclined face 451C moves along the protruding portion 427A. At this time, in the state in which the movable roller 430 is in the clamping position, the second link 420 is held in place by the energizing force of the torsion spring 499 (refer to FIG. 5). In other words, the first link 410 is pivoted in the second direction by the coupling mechanism 150, independently of the second link 420. Note that the holding member 490, which is supported by the support portion 452, pivots in the second direction together with the first link 410.

As shown in FIG. 12G, immediately after the first link 410 starts to pivot in the second direction (refer to FIG. 13A to FIG. 13E), the second restricting member 458 withdraws from the second rotation area and moves to the second permitting position. At this time, the movable roller 430 is held in the specific rotational position by the sliding friction between the rotating shaft 445 and the round holes 428A and 428B (refer to FIG. 4 and FIG. 10).

In contrast, the first restricting member 450 moves in the second direction together with the second restricting member 458. At this time, the restricting portion 454 comes into contact from the right with the flat portion 433A on the right side and presses the flat portion 433A on the right side to the left. More specifically, the restricting portion 454 comes into contact with the part of the flat portion 433A on the right side that is to the rear of the rotational axis X (refer to FIG. 10). This causes the movable roller 430 to rotate forward to a position where the flat portion 433A that is being pressed is opposite the rear edge face of the restricting portion 454. The first restricting member 450 rotates the movable roller 430 forward by one-fourth of a revolution and arrives at the first restricting position. This forward rotation of the movable roller 430 will be called the second forward rotation.

In this case, before the second forward rotation starts, the movable roller 430 is stopped at the specific rotational position. Therefore, the direction in which the two flat portions 433A extend is substantially orthogonal to the direction of the movement of the first restricting member 450. Accordingly, when the restricting portion 454 presses against the flat portion 433A on the right side during the second forward rotation, the load that acts on the flat portion 433A on the right side tends not to be dispersed.

As shown in FIG. 12H, during the second forward rotation, the movable roller 430 operates in coordination with the fixed roller 440 to feed the fully cut print tape 57 toward the discharge port 111 (refer to FIG. 1). The rear end portion of the print tape 57 is released from the area where it is clamped between the movable roller 430 and the fixed roller 440 and is discharged toward the discharge port 111.

After the feed mechanism 400 has discharged the print tape 57, the motor 90 turns farther in the first drive direction. The contact face 451B of the first link 410, which pivots in the second direction, thus comes into contact with protruding portion 427A from the second direction side and presses the protruding portion 427A in the first direction (refer to FIG. 13E). This causes the second link 420, which has moved the movable roller 430 to the clamping position, to pivot in the second direction together with the first link 410. The motor 90 turns farther in the first drive direction, causing the cam plate 760 to move to the reference position. This causes the cutting mechanism 80 to return to the standby state. The operation that is described above causes the print tape 57 to be discharged from the discharge port 111 by the feed mechanism 400 after it has been fully cut by the full-cut mechanism 300.

Motor Control During Full Cut

The rotation control of the motor 90 by the control portion 20 (refer to FIG. 3) in a case where the print tape 57 is fully cut and discharged will be explained with reference to FIG. 7 and FIG. 14. The rotational position where the cam plate 760 causes the movable portion 320 to move to the second cutting position will be called the second displacing position. As the cam plate 760 rotates from the reference position to the second cutting position, the front peripheral surface 760A rotates while sliding in relation to the movable pin 91A. When the cam plate 760 rotates to the second displacing position, the second detection plate 766 comes into contact with the movable pin 91A. The movable pin 91A changes from the steady state to the tilted state, so the detection sensor 91 changes from the OFF state to the ON state.

As the cam plate 760 rotates from the reference position to the second displacing position, the rear peripheral surface 760B rotates while sliding in relation to the movable pin 92A. When the cam plate 760 rotates to the second displacing position, the protruding portion 762 comes into contact with the movable pin 92A. The movable pin 92A changes from the steady state to the tilted state, so the detection sensor 92 changes from the OFF state to the ON state.

Therefore, in a case where the detection sensors 91 and 92 have both changed to the ON state when the motor 90 turns in the second drive direction, the control portion 20 determines that the cam plate 760 has rotated to the second displacing position. In that case, the control portion 20 causes the motor 90 to turn farther by a specified amount, then stops the operation of the motor 90. In this way, the cutting mechanism 80 fully cuts the print tape 57, and the feed mechanism 400 feeds and discharges the fully cut print tape 57.

The control portion 20 then rotates the cam plate 760 in the first cutting direction from the second displacing position. The control portion 20 rotates the cam plate 760 in the first cutting direction until the detection sensor 92 changes from the ON state to the OFF state (that is, until the protruding portion 762 moves away from the movable pin 92A). When the detection sensor 92 has changed from the ON state to the OFF state, the control portion 20 stops the operation of the motor 90. The cutting mechanism 80 thus returns to the standby state.

Operation of Clutch Spring 446

Figure 15:
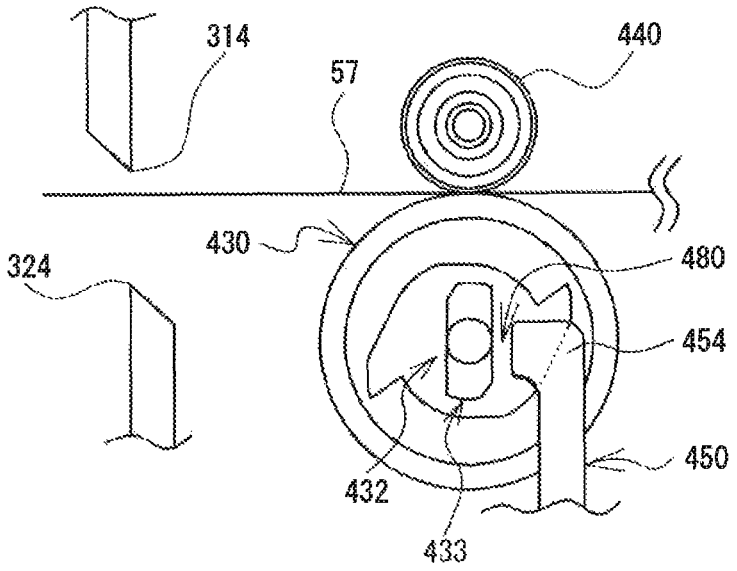
FIG. 15 is a bottom view that shows a state in which a gap is formed between an engaging portion and a restricting portion.

The operation of the clutch spring 446 before the movable roller 430 performs the first forward rotation will be explained with reference to FIG. 9 and FIG. 15. Note that in FIG. 15, to facilitate understanding, a gap 480 (hereinafter described) is shown larger than its actual size.

In some cases, the gap 480 is formed between the coupled portion 433 and the first restricting member 450, which is in the first restricting position, prior to the first forward rotation. For example, the gap 480 is sometimes provided intentionally in order to prevent the coupled portion 433 and the restricting portion 454 from interfering with one another prior to the first forward rotation. A manufacturer may form the gap 480 by adjusting the sizes, the shapes, and the like of the movable roller 430 and the first restricting member 450.

Note that the reason for forming the gap 480 is not limited to this example. For example, in some cases, a torque that causes the movable roller 430 to rotate in reverse is generated by vibration or the like that occurs in the printer 1. In these cases, when the gap 480 is formed, there is a possibility that the movable roller 430 will rotate unintentionally in the gap 480. In the present embodiment, the clutch spring 446 prevents the movable roller 430 from rotating in reverse in a case where a torque is generated that causes the movable roller 430 to rotate in reverse. Therefore, prior to the first forward rotation, the rotational position of the movable roller 430 in the clamping position is stable. Unintentional feeding of the print tape 57 that is clamped by the fixed roller 440 and the movable roller 430 is inhibited. Therefore, the position of the print tape 57 prior to the first forward rotation is more stable, and any variation in the amount of the print tape 57 that is discharged is less than in a case where the clutch spring 446 is not provided.

Examples of Operational Effects of the Present Embodiment

In the clamping position, the movable roller 430 clamps the print tape 57 against the fixed roller 440. By rotating forward through the first forward rotation and the second forward rotation, the movable roller 430 feeds the fully cut print tape 57 and discharges it to the discharge port 111. Prior to the first forward rotation, reverse rotation of the movable roller 430 that is in the clamping position is prevented by the clutch spring 446, which is a one-way clutch. Forward rotation of the coupled portion 433 is restricted even in a case where the gap 480 is provided between the coupled portion 433 and the restricting portion 454, which is in the first restricting position. The rotational position of the movable roller 430 that is in the clamping position is therefore stable prior to the feeding of the print tape 57, so the position of the print tape 57 that is clamped between the fixed roller 440 and the movable roller 430 is stable.

When the movable roller 430 is in the released position, the coupling mechanism 150 causes the first link 410 and the second link 420 to pivot together in the first direction. When the movable roller 430 is in the clamping position, the coupling mechanism 150 causes the first link 410 to pivot in the first direction independently of the second link 420. When the pressing member 472 is in the separated position, the coupling mechanism 250 causes the first link 410 and the holding member 490 to pivot together in the first direction. When the pressing member 472 is in the contact position, the coupling mechanism 250 causes the first link 410 to pivot in the first direction independently of the holding member 490. Therefore, in the feed mechanism 400, the first link 410, the second link 420, and the holding member 490 may pivot in conjunction as described above, even if there is only the one motor 90 to serve as the drive source. The feed mechanism 400 may thus be made more compact, and its cost may be reduced.

The coupling mechanism 150 has a simple structure that includes the torsion spring 499, the protruding portion 427A, and the wall portion 451A. The coupling mechanism 250 has a simple structure that includes the support portion 452, the left wall portion 490A, and the protruding piece 419. The feed mechanism 400 may therefore be made even more compact.

The feed mechanism 400 includes the coil spring 471 as an energizing portion for causing the movable roller 430 to perform the first forward rotation. The coil spring 471 is disposed in the space (the gap 493) where the protruding piece 419 moves in the first direction in relation to the right wall portion 490B. The space where the protruding piece 419 moves may also be used as the space in which the coil spring 471 is disposed. The feed mechanism 400 may therefore be made even more compact.

The one-way clutch that the feed mechanism 400 has is the clutch spring 446. Therefore, the mechanism that prevents the movable roller 430 from rotating in reverse may be simplified.

The specific rotational position of the movable roller 430 is the rotational position where the direction in which the flat portions 433A extend is orthogonal to the direction of the movement of the first restricting member 450. In a case where the restricting portion 454 causes the movable roller 430 to rotate forward, the load that the restricting portion 454 causes to act on the flat portion 433A tends not to be dispersed. Therefore, the first restricting member 450 may perform the second forward rotation of the movable roller 430 smoothly. The feed mechanism 400 may perform the second forward rotation of the movable roller 430 efficiently.

The sliding of the wall portion 472A, which connects the pressing portion 472B and the right wall portion 490B, in relation to the gradually increasing portion 432C stops the first forward rotation of the movable roller 430. The member that causes the movable roller 430 to perform the first forward rotation is thus the same member that stops the first forward rotation of the movable roller 430. The structure of the feed mechanism 400 may therefore be simplified.

The cutting mechanism 80 moves the movable blade 324 to the second cutting position and fully cuts the print tape 57 after the pressing member 472 moves to the contact position and before the first restricting member 450 moves to the first permitting position. The fully cut print tape 57 is fed by the feed mechanism 400 to the discharge port 111 and discharged. Therefore, the cutting mechanism 80 may achieve stabilization of the rotational position of the movable roller 430 before the print tape 57 is fed.

The printed print tape 57 is fully cut when it is supplied to the cutting mechanism 80, and then it is fed to the discharge port 111 and discharged. Therefore, the printer 1 may achieve stabilization of the rotational position of the movable roller 430 before the print tape 57 is fed.

The present disclosure is not limited to the embodiment that is described above, and various types of modifications can be made. The feed mechanism 400 does not have to be provided in the cutting mechanism 80. The feed mechanism 400 may also be a device that can be used independently, and it may also be provided in a portion of the another device that uses a sheet material such as paper, film, or the like.

The fixed roller 440 may also be disposed on the left side of the movable roller 430 instead of being disposed on the right side of the movable roller 430. In that case, the movable roller 430 may pivot between the clamping position and the released position by pivoting on the right side of the fixed roller 440.

The coil portion 446A of the clutch spring 446 may also be provided on the upper wall portion 428C instead of being provided on the rotating shaft 445. More specifically, a rotating shaft that holds the coil portion 446A may be provided on the upper wall portion 428C. In that case as well, the clutch spring 446 may prevent the movable roller 430 from rotating in reverse.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A feed device, comprising:

a first roller;

a second roller that is configured to:

move between a clamping position and a released position; and rotate in a forward rotation direction and a reverse rotation direction, the forward rotation direction and the reverse rotation direction being opposite rotational directions, the clamping position being a position in which the second roller clamps a sheet material between the first roller and the second roller, the released position being a position in which the second roller is more separated from the first roller than when the second roller is in the clamping position, the second roller also being configured to feed the sheet material that is clamped between the first roller and the second roller toward a discharge position when the second roller is in the clamping position and rotates in the forward rotation direction;

a first protruding portion provided on the second roller and that protrudes in a direction that is parallel to a rotational axis of the second roller;

a plurality of second protruding portions provided in the first protruding portion and that protrude in directions that are orthogonal to the rotational axis of the second roller;

a first restricting member that is configured to move between a first restricting position and a first permitting position, the first restricting position being a position in which the first restricting member is in a first rotation area and restricts rotation of the second roller in the forward rotation direction, the first rotation area being an area in which the first protruding portion moves when the first protruding portion rotates in the forward rotation direction, the first permitting position being a position in which the first restricting member is outside the first rotation area and permits the second roller to rotate in the forward rotation direction;

an energizing portion that is configured to move between a contact position and a separated position, the contact position being a position in which the energizing portion is in contact with and energizes one of the plurality of the second protruding portions, the separated position being a position in which the energizing portion is more separated from the rotational axis of the second roller than when the energizing portion is in the contact position, the energizing portion also being configured to cause the second roller to rotate in the forward rotation direction when the energizing portion moves to the contact position;

a second restricting member that is configured to move between a second restricting position and a second permitting position, the second restricting position being a position in which the second restricting member is in a second rotation area and restricts rotation of the second roller in the forward rotation direction, the second rotation area being an area that the plurality of the second protruding portions move when the plurality of the second protruding portions rotate in the forward rotation direction, the second permitting position being a position in which the second restricting member is outside the second rotation area and permits the second roller to rotate in the forward rotation direction, the second restricting member also being configured to cause rotation of the second roller to stop in a specific rotational position by coming into contact with a specific one of the second protruding portions when the second restricting member reaches the second restricting position, the specific one of the second protruding portions being a different one of the plurality of the second protruding portions than the second protruding portion with which the energizing portion comes into contact;

a first actuating portion that is configured to move the energizing portion from the separated position to the contact position, and to subsequently move the first restricting member from the first restricting position to the first permitting position and move the second restricting member from the second permitting position to the second restricting position; and a second actuating portion that is configured to move the second restricting member from the second restricting position to the second permitting position and to subsequently cause the second roller that is rotated by the first actuating portion to rotate farther in the forward rotation direction while maintaining a state in which the second roller is in the clamping position.

2. The feed device according to claim 1, wherein:

the first actuating portion includes:

a shaft member that extends in a fixed direction, a first pivoting member that supports the second roller, the first pivoting member being configured to move the second roller from the released position to the clamping position by pivoting in a first direction around the shaft member, a second pivoting member that supports the energizing portion, the second pivoting member being configured to move the energizing portion from the separated position to the contact position by pivoting in the first direction around the shaft member, a third pivoting member that supports the first restricting member and the second restricting member, the third pivoting member being configured to move the first restricting member from the first restricting position to the first permitting position and move the second restricting member from the second permitting position to the second restricting position by pivoting in the first direction around the shaft member, a drive portion that is configured to cause the third pivoting member to pivot in the first direction, and a pivoting mechanism that is configured to cause the first pivoting member and the second pivoting member to pivot in the first direction in conjunction with the third pivoting member, and the pivoting mechanism includes:

a first coupling mechanism that is configured to cause the first pivoting member and the second pivoting member to pivot together with the third pivoting member in the first direction when the first pivoting member moves the second roller from the released position to the clamping position, while maintaining a state in which: the energizing portion is in the separated position, the first restricting member is in the first restricting position, and the second restricting member is in the second permitting position, the first coupling mechanism also being configured to cause the second pivoting member and the third pivoting member to pivot in the first direction independently of the first pivoting member when the energizing portion moves from the separated position to the contact position, in a state in which the second roller is in the clamping position, and a second coupling mechanism that is configured to cause the third pivoting member to pivot in the first direction independently of the second pivoting member when the first restricting member is moved from the first restricting position to the first permitting position and the second restricting member is moved from the second permitting position to the second restricting position, in a state in which the energizing portion is in contact with the second roller.

3. The feed device according to claim 2, wherein:

the first pivoting member and the third pivoting member are provided on the shaft member such that the first pivoting member and the third pivoting member are lined up in the fixed direction, the second pivoting member is provided in the third pivoting member, the first roller is disposed in a position in which the first roller is opposite the second roller when the second roller is in the clamping position, the first coupling mechanism includes:

a first wall portion that is a wall portion provided in the third pivoting member, a third protruding portion that protrudes from the first pivoting member toward the third pivoting member, the third pivoting member being disposed in a second direction from the first wall portion, the second direction being opposite to the first direction, a first elastic member that energizes the first pivoting member in the first direction, and a support portion that is provided in the third pivoting member, the support portion being configured to support the second pivoting member from the second direction side and to cause the second pivoting member to pivot in the first direction together with the third pivoting member, and the third pivoting member is configured to pivot in the first direction independently of the first pivoting member by causing the first wall portion to move in the first direction in relation to the third protruding portion, when the third pivoting member moves the first restricting member from the first restricting position to the first permitting position and moves the second restricting member from the second permitting position to the second restricting position.

4. The feed device according to claim 3, wherein:

the support portion is configured to slide in relation to the second pivoting member, the second coupling mechanism includes:

a second wall portion that is a wall portion provided in the second pivoting member, and a fourth protruding portion that protrudes from the third pivoting member toward the second pivoting member, the fourth protruding portion being disposed in the second direction from the second wall portion, and being disposed opposite the second wall portion, with a gap between the fourth protruding portion and the second wall portion, and the third pivoting member is configured to pivot in the first direction independently of the second pivoting member by causing the support portion to slide in relation to the second pivoting member and causing the fourth protruding portion to pivot in relation to the second wall portion, when the third pivoting member moves the first restricting member from the first restricting position to the first permitting position and moves the second restricting member from the second permitting position to the second restricting position.

5. The feed device according to claim 4, wherein:

the energizing portion includes:

a second elastic member that is disposed in the gap in a state in which the second elastic member is supported by the second wall portion and the fourth protruding portion, and a fifth protruding portion that is disposed in the second pivoting member and that protrudes from the second wall portion toward the opposite side from the second elastic member, the fifth protruding portion being configured to come into contact with the second protruding portions when the energizing portion is in the contact position, and the second elastic member is configured to energize the second protruding portions through the fifth protruding portion, when the energizing portion is in the contact position, by elastically deforming when the fourth protruding portion moves in the first direction from the second wall portion.

6. The feed device according to claim 4, wherein:

the second actuating portion includes:

the first pivoting member, the third pivoting member, the drive portion, and a third coupling mechanism that is configured to cause the third pivoting member to pivot in the second direction independently of the first pivoting member when the third pivoting member moves the first restricting member from the first permitting position to the first restricting position and moves the second restricting member from the second restricting position to the second permitting position, in a state in which the second roller is in the clamping position, the third coupling mechanism includes:

the first wall portion, the third protruding portion, and the first elastic member, the first protruding portion is configured to advance into a movement area when the second roller is stopped at the specific rotational position, the movement area being an area through which the first restricting member passes when the first restricting member moves between the first restricting position and the first permitting position, the third pivoting member is configured to move the first restricting member from the first permitting position to the first restricting position and to move the second restricting member from the second restricting position to the second permitting position, independently of the first pivoting member, by moving the first wall portion in the second direction in relation to the third protruding portion, the second roller is configured to be caused to rotate in the forward rotation direction by the second restricting member beginning to move from the second restricting position to the second permitting position, and the first restricting member is configured to cause the first protruding portion to rotate in the forward rotation direction by pressing on the first protruding portion while moving from the first permitting position to the first restricting position.

7. The feed device according to claim 4, wherein the specific rotational position is a rotational position of the second roller in which the first protruding portion is pressed by the first restricting member when the first restricting member moves to the first restricting position.

8. The feed device according to claim 6, wherein:

the first protruding portion includes a flat portion that is formed in a planar shape, the first restricting member is configured to cause the first protruding portion to rotate in the forward rotation direction by pressing on the flat portion when the first restricting member moves from the first permitting position to the first restricting position, and the specific rotational position is a rotational position of the second roller in which a direction in which the flat portion extends is orthogonal to the direction in which the first restricting member moves.

9. The feed device according to claim 1, further comprising:

a clutch that is configured to permit the second roller to rotate in the forward rotation direction and to restrict the second roller from rotating in the reverse rotation direction.

10. The feed device according to claim 9, wherein the clutch is a clutch spring.

11. A printer that is provided with the feed device that is described in claim 1, comprising:

a printing portion that is configured to print on a sheet material;

a supply portion that is configured to supply, to the first roller, the sheet material on which printing is performed by the print portion; and a cutting portion that is configured to cut the sheet material after the energizing portion is moved from the separated position to the contact position and before the first restricting member is moved from the first restricting position to the first permitting position.

* * * * *